US006474294B2

(12) United States Patent
Yamazaki et al.

(10) Patent No.: US 6,474,294 B2
(45) Date of Patent: Nov. 5, 2002

(54) DIRECT INJECTION TYPE INTERNAL COMBUSTION ENGINE CONTROL APPARATUS AND CONTROL METHOD OF THE SAME

(75) Inventors: Daichi Yamazaki, Toyota (JP); Naoki Kurata, Nishikamo-gun (JP); Masanori Sugiyama, Aichi-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 45 days.

(21) Appl. No.: 09/850,266

(22) Filed: May 8, 2001

(65) Prior Publication Data

US 2001/0042535 A1 Nov. 22, 2001

(30) Foreign Application Priority Data

May 9, 2000 (JP) ..... 2000-136046

(51) Int. Cl.[7] ..... F02B 17/00
(52) U.S. Cl. ..... 123/295; 123/179.4
(58) Field of Search ..... 123/295, 179.4

(56) References Cited

U.S. PATENT DOCUMENTS 3,824,978 A * 7/1974 Paquette ..... 123/185.14
3,927,652 A * 12/1975 O'Neill ..... 123/294
5,977,646 A * 11/1999 Lenz et al. ..... 123/179.4
2002/0033157 A1 * 3/2002 Thompson et al. ..... 123/179.4

FOREIGN PATENT DOCUMENTS

JP A-10-47104 2/1998
JP A-10-299543 11/1998

* cited by examiner

*Primary Examiner*—Erick Solis
(74) *Attorney, Agent, or Firm*—Kenyon & Kenyon

(57) ABSTRACT

A direct injection type internal combustion engine control apparatus is capable of increasing the frequency of performing the compression-stroke fuel injection following an automatic start of the engine by maintaining a sufficient fuel pressure for the compression-stroke injection even after the engine has been stopped by an automatic stop function. When an immediately-before-automatic-stop flag is "ON", the control apparatus sets the control duty of an electromagnetic spill valve to 100 (%) to raise the fuel pressure immediately before the automatic stop. As a result, after the engine stops, the fuel pressure starts to decrease from a high pressure, so that there will be a long time before the fuel pressure decreases to a level that makes it impossible to perform appropriate fuel injection into the combustion chamber during the compression stroke. Therefore, the possibility of performance of the compression-stroke injection immediately following an automatic start is increased, and the frequency of performing the compression-stroke injection is increased. Thus, sufficient improvements in fuel economy and the like can be achieved.

20 Claims, 18 Drawing Sheets

DIRECT INJECTION TYPE INTERNAL COMBUSTION ENGINE CONTROL APPARATUS AND CONTROL METHOD OF THE SAME

INCORPORATION BY REFERENCE

The disclosure of Japanese Patent Application No. 2000-136046 filed on May 9, 2000 including the specification, drawings and abstract is incorporated herein by reference in its entirety.

BACKGROUND OF THE INVENTION

1. Field of the Invention

The invention relates to a control apparatus and a control method of a direct injection type internal combustion engine in which fuel delivered from a fuel pump is directly injected into a combustion chamber from a fuel injection valve and the thus-formed mixture is ignited by an ignition plug. In particular, the invention relates to a direct injection type internal combustion engine control apparatus that automatically stops a direct injection type internal combustion engine if during operation of the internal combustion engine, the operating state of the engine meets an automatic stop condition, and that automatically starts operation of the engine if an automatic start condition is met.

2. Description of Related Art

A conventional direct injection type internal combustion engine is known which realizes lean burn when the engine is in a low load state, for example, during idling or the like, and thereby achieves both high output and reduced fuel consumption and also reduces emissions of carbon dioxide and the like (Japanese Patent Application Laid-Open No. 10-299543). In order to ensure that the mixture will be ignited without fail during lean burn, such a direct injection type internal combustion engine performs stratified charge combustion in which fuel is injected during the compression stroke to provide a fuel-rich mixture stratified around the ignition plug before being ignited to burn. In a case where the combustion is to be performed at a stoichiometric air-fuel ratio, the engine performs uniform combustion in which fuel is injected during the intake stroke to produce a state in which fuel is uniformly dispersed in the entire combustion chamber before being burned.

An automatic stop/start apparatus for an automotive internal combustion engine, that is, a generally-termed economy running system, is known which, for the purpose of improving fuel economy or the like, automatically stops the internal combustion engine at the time of a stop of the motor vehicle at an intersection or the like, and then automatically starts the engine by turning the starter upon an operation for starting the vehicle so that the vehicle can be pulled off (Japanese Patent Application Laid-Open No. HEI 10-47104).

Therefore, by combining this automatic stop/start apparatus with the above-described direct injection type internal combustion engine, a further fuel economy improvement can be expected.

For fuel injection during the compression stroke of a direct injection type internal combustion engine, fuel needs to be injected into a high-pressure combustion chamber. Therefore, a typical direct injection type internal combustion engine employs a high-pressure fuel pump to highly pressurize fuel and deliver high-pressure fuel toward the fuel injection valve side.

However, when such a direct injection type internal combustion engine is automatically stopped by the automatic stop/start apparatus, the high-pressure fuel pump also stops. Therefore, during the automatic stop, high-pressure fuel is not supplied to the fuel injection valve side. Even though the fuel injection valve side, including the fuel piping, is tightly closed, fuel gradually leaks. Therefore, during the automatic stop, the accumulated fuel pressure drops.

After that, at the time of an automatic start, the driving of the fuel pump is started. However, if the fuel pressure is insufficient for the compression-stroke fuel injection due to a fuel pressure decrease occurring during the automatic stop, it is inevitable to perform uniform combustion in which fuel is injected during the intake stroke during which good injection is possible even at low fuel injection pressure, until a sufficient fuel pressure is recovered. Therefore, even if the operating state of the engine other than the fuel pressure allows stratified charge combustion upon automatic start, the uniform combustion must be performed. Hence, the improvement in fuel economy and the like may become insufficient.

SUMMARY OF THE INVENTION

It is an object of the invention to provide a direct injection type internal combustion engine control apparatus capable of maintaining a sufficient fuel pressure for the compression-stroke fuel injection for a long time even after the internal combustion engine has been stopped by an automatic stop function, and capable of increasing the frequency of performing the compression-stroke injection after the engine is automatically started. Operation and advantages obtained by the invention will be described.

A control apparatus of. a direct injection type internal combustion engine in which an air-fuel mixture formed by injecting a fuel delivered from a fuel pump, directly from a fuel injection valve into a combustion chamber, is ignited by an ignition plug, the control apparatus is provided with an automatic stop permitting unit that permits an automatic stop of the internal combustion engine if during an operation of the internal combustion engine, an operating state of the internal combustion engine meets an automatic stop condition, an automatic start permitting unit that permits an automatic start of the internal combustion engine if the operating state of the internal combustion engine meets an automatic start condition, and a fuel pressure raising unit that raises a fuel pressure on a fuel injection valve side during a first period of time_prior to the automatic stop permitted by the automatic stop permitting unit.

The fuel pressure raising unit raises the fuel pressure on the fuel injection valve side immediately prior. to the automatic stop. Therefore, after the delivery of high-pressure fuel from the fuel pump stops upon the automatic stop of the direct injection type internal combustion engine, the fuel pressure starts to gradually decrease from a higher fuel pressure, in comparison with the conventional art in which the engine is stopped with an ordinary fuel pressure state. As a result, a long time of engine stop is allowed before the fuel pressure decreases to a pressure that makes it impossible to perform appropriate fuel injection into the combustion chamber during the compression stroke.

Therefore, the possibility that a fuel pressure sufficient for the compression-stroke fuel injection will be maintained immediately after a subsequent automatic start is increased. If such a fuel pressure is maintained, the stratified charge combustion can be accomplished by performing the compression-stroke injection immediately after the subsequent automatic start provided that the internal combustion engine is in an operating state that allows the stratified charge combustion. Thus, the frequency of performing the compression-stroke injection following an automatic start can be increased, and sufficient improvements in fuel economy and the like can be achieved.

The fuel pressure raising unit raises the fuel pressure on the fuel injection valve side during the first period of time prior to the automatic stop by adjusting an amount of the fuel delivered from the fuel pump to a maximum.

Thus, by maximizing the amount of delivery from the fuel pump, the fuel pressure can be quickly brought to a sufficiently high pressure state. As a result, the frequency of performing the compression-stroke injection following an automatic start is further increased, and a fuel economy improvement and the like will become more effective.

The internal combustion engine includes a relief valve that opens and discharges the fuel from the fuel injection valve side when the fuel pressure on the fuel injection valve side reaches at least a predetermined valve opening pressure. During the first period of time prior to the automatic stop, the fuel pressure raising unit raises the fuel pressure on the fuel injection valve side so as to temporarily open the relief valve by adjusting the amount of the fuel delivered from the fuel. pump to the maximum.

During the pressure raise continuation duration immediately prior to the automatic stop, the fuel pressure raising unit raises the fuel pressure by adjusting the amount of delivery from the fuel pump to the maximum, so that the relief valve is temporarily opened. This may open the relief valve, which is hardly ever opened during normal operation.

Therefore, in addition to achieving sufficient improvements in fuel economy and the like by increasing the frequency of performing the compression-stroke injection following an automatic start, the control apparatus is able to prevent the locking or fixation of the relief valve or the clogging thereof with a foreign matter, which is likely to occur after the relief valve has not been opened for a long time.

Furthermore, by setting a long pressure raise continuation duration so as to deliver a large amount of high-pressure fuel toward the fuel injection valve side and to discharge fuel via the relief valve, a reduced fuel temperature on the fuel injection valve side can be achieved immediately prior to the automatic stop. Therefore, it is possible to maintain a sufficiently high fuel pressure achieved by thermal expansion caused by increases in the fuel temperature during the automatic stop of the engine. Consequently, the frequency of performing the compression-stroke injection following an automatic stop can be further increased, and improvements in fuel economy and the like can be more effectively achieved.

The control apparatus is further provided with a fuel pressure control unit that adjusts the fuel pressure on the fuel injection valve side to a target fuel pressure that is set in accordance with the operating state of the internal combustion engine by adjusting an amount of the fuel delivered from the fuel pump. The fuel pressure raising unit raises the fuel pressure on the fuel injection valve side prior to the automatic stop by correcting the target fuel pressure to a higher level.

If the fuel pressure control unit adjusts the fuel pressure to a target fuel pressure in accordance with the operating state of the internal combustion engine by adjusting the amount of delivery from the fuel pump, the fuel pressure raising unit is able to raise the fuel pressure by correcting the target fuel pressure set by the fuel pressure control unit in accordance with the operating state of the internal combustion engine to an increase side immediately prior to the automatic stop.

Therefore, immediately prior to the automatic stop, the control apparatus realizes a high fuel pressure that is higher than a usual fuel pressure adjusted by the fuel pressure control unit. As a result, a longer-than-usual time of engine stop is allowed before the fuel pressure decreases to a pressure that makes it impossible to perform fuel injection into the combustion engine during the compression-stroke injection.

Therefore, the possibility of performance of the compression-stroke injection immediately following a subsequent automatic start is increased, and the frequency of performing the compression-stroke injection is increased. Thus, sufficient improvements in fuel economy and the like can be achieved.

The internal combustion engine includes a relief valve that opens and discharges the fuel from the fuel injection valve side when the fuel pressure on the fuel injection valve side reaches at least a predetermined valve opening pressure. The fuel pressure raising unit raises the fuel pressure on the fuel injection valve side to at least the predetermined valve opening pressure of the relief valve prior to the automatic stop.

The fuel pressure raising unit raises the fuel pressure to at least the predetermined valve opening pressure of the relief valve provided on the fuel injection valve side, immediately prior to the automatic stop. This provides an occasion of opening the relief valve, which is hardly ever opened during normal operation.

Therefore, in addition to achieving sufficient improvements in fuel economy and the like by increasing the frequency of performing the compression-stroke injection following an automatic start, the control apparatus is able to prevent the fixation of the relief valve or the clogging thereof with a foreign matter, which is likely to occur after the relief valve has not been opened for a long time.

The internal combustion engine includes a relief valve that opens and discharges the fuel from the fuel injection valve side when the fuel pressure on the fuel injection valve side reaches at least a predetermined valve opening pressure. The fuel pressure raising unit raises the fuel pressure on the fuel injection valve side to at least the predetermined valve opening pressure of the relief valve prior to the automatic stop.

Thus, during the pressure raise continuation duration after the fuel pressure raising means raises the fuel pressure to or above the set valve opening pressure of the relief valve, the fuel pressure raising means further continues the process of raising the fuel pressure to or above the predetermined valve opening pressure of the relief valve. Therefore, during the pressure raise continuation duration just prior to the automatic stop, the relief valve is continuously or repeatedly opened, so that a large amount of fuel can be delivered toward the fuel injection valve side and a large amount of fuel can be discharged via the relief valve. Hence, in addition to achieving sufficient improvements in fuel economy and the like by increasing the frequency of performing the compression-stroke injection following an automatic start, the control apparatus is able to prevent the fixation of the relief valve or the clogging thereof with a foreign matter, which is likely to occur after the relief valve has not been opened for a long time.

Furthermore, by setting the pressure raise continuation duration, it becomes possible to deliver a large amount of fuel toward the fuel injection valve side and discharge a large amount of fuel via the relief valve. Thus, a reduced fuel temperature on the fuel injection valve side can be achieved immediately before the automatic stop. Hence, it becomes possible to maintain a sufficiently high fuel pressure achieved by thermal expansion caused by increases in the fuel temperature during the automatic stop of the engine. Consequently, the frequency of performing the compression-stroke injection following an automatic stop can be further increased, and improvements in fuel economy and the like can be more effectively achieved.

DETAILED DESCRIPTION OF PREFERRED EMBODIMENTS

First Embodiment

Figure 1:
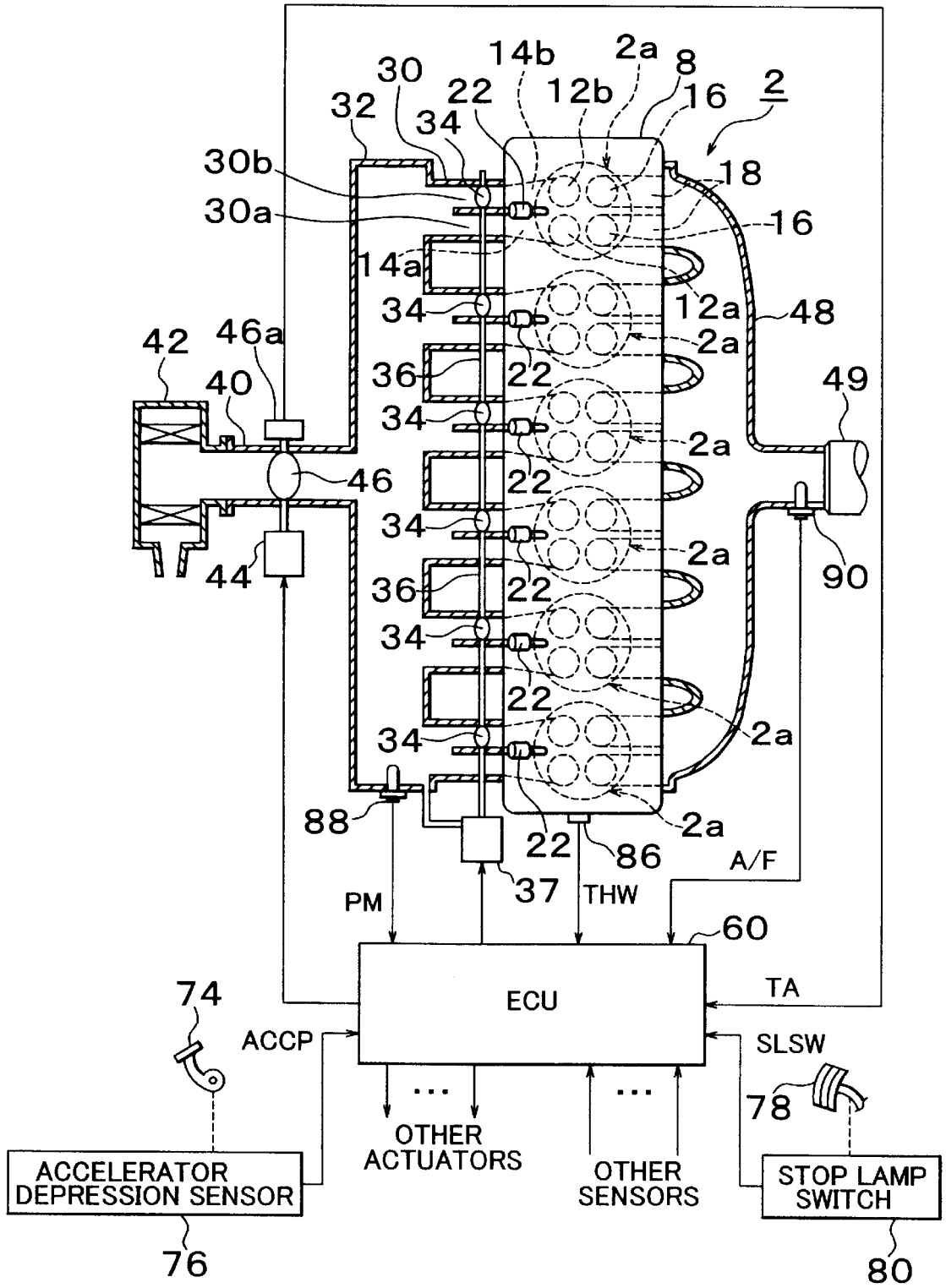
FIG. 1 is a schematic diagram illustrating a construction of a direct injection type internal combustion engine in accordance with Embodiment 1.
Figure 2:
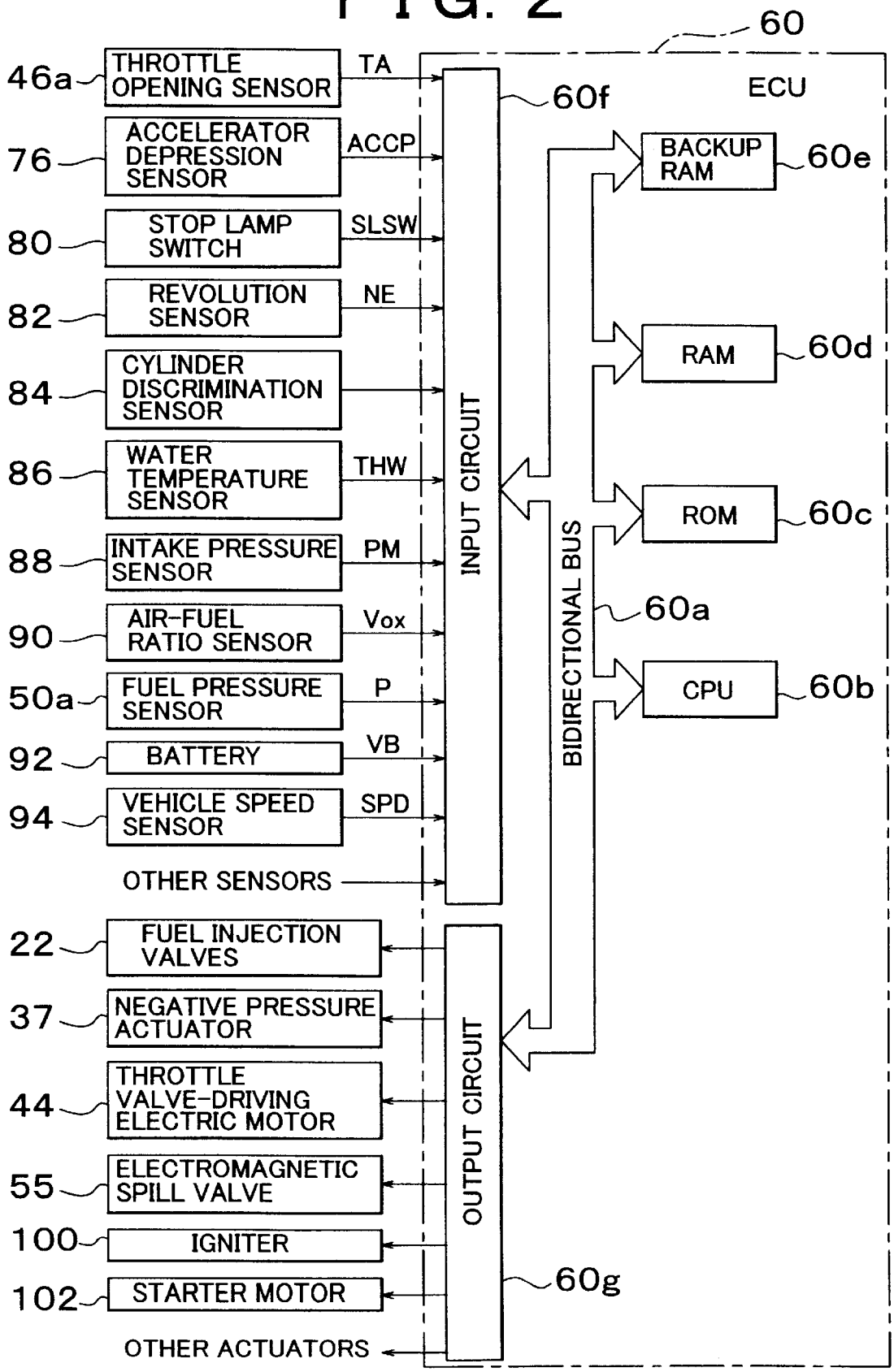
FIG. 2 is a block diagram of a control system of the direct injection type internal combustion engine in accordance with Embodiment 1.

FIG. 1 schematically illustrates a direct injection type internal combustion engine to which the above-described invention is applied. FIG. 2 shows a block diagram of a control system of the direct injection type internal combustion engine.

A gasoline engine (hereinafter, referred to as an "engine") 2 provided as a direct injection type internal combustion engine is installed in a motor vehicle for driving the vehicle. The engine 2 has six cylinders 2*a*. As shown in FIGS. 3 to 6, each cylinder 2*a* has a combustion chamber 10 that is defined by a cylinder block 4, a piston 6 provided for reciprocating movements within the cylinder block 4, and a cylinder head 8 disposed on top of the cylinder block 4.

Each combustion chamber 10 is provided with a first intake valve 12*a*, a second intake valve 12*b*, and a pair of exhaust valves 16. The first intake valve 12*a* is connected to a first intake port 14*a*. The second intake valve 12*b* is connected to a second intake port 14*b*. The two exhaust valves 16 are connected to two exhaust ports 18, respectively.

Figure 3:
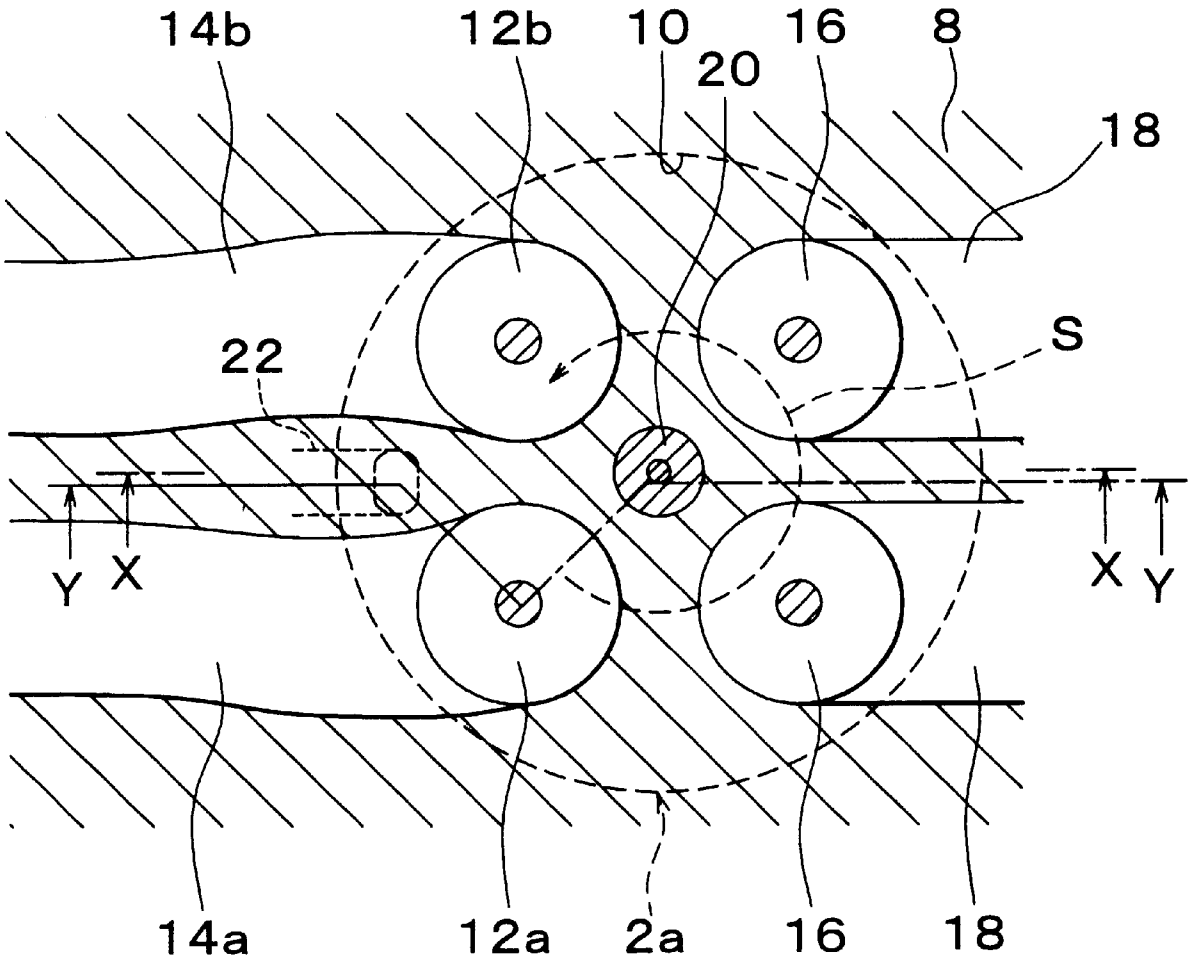
FIG. 3 is a horizontal sectional view of a cylinder head in Embodiment 1.

FIG. 3 is a horizontal sectional view of a portion of the cylinder head 8 corresponding to a cylinder. As shown in FIG. 3, the first intake port 14*a* and the second intake port 14*b* of each cylinder are straight intake ports that extend substantially linearly. An ignition plug 20 is disposed in a central portion of an inner wall surface of the cylinder head 8. A fuel injection valve 22 is disposed in a peripheral portion of an inner wall surface of the cylinder head 8 that is adjacent to both the first intake valve 12*a* and the second intake valve 12*b*. Each fuel injection valve 22 is disposed so that fuel can be injected therefrom directly into the combustion chamber.

Figure 4:
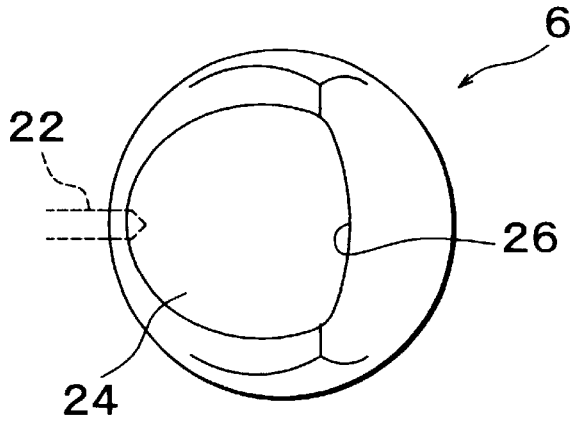
FIG. 4 is a plan view of a top surface of a piston in Embodiment 1.
Figure 5:
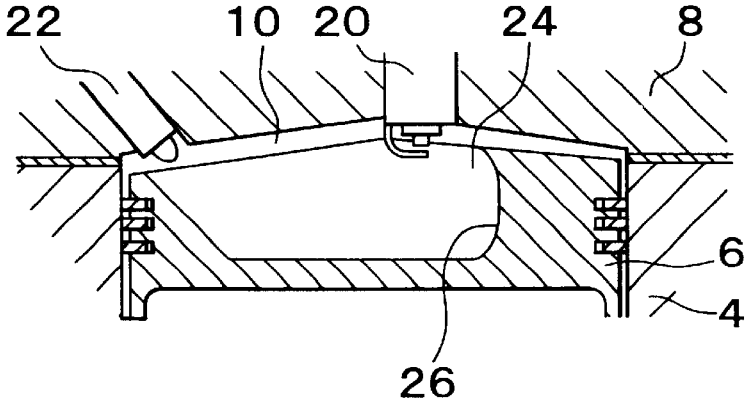
FIG. 5 is a section taken on line X—X in FIG. 3.
Figure 6:
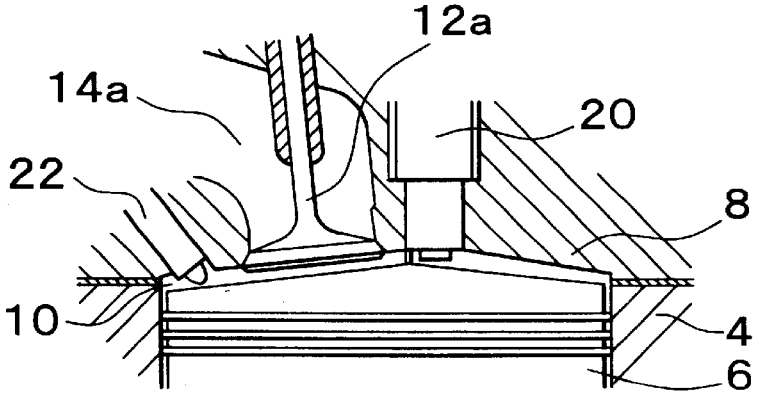
FIG. 6 is a section taken on line Y—Y in FIG. 3.

FIG. 4 is a plan view of a stop surface of a piston 6. FIG. 5 is a section taken on line X—X in FIG. 3. FIG. 6 is a section taken on line Y—Y in FIG. 3. As shown in the drawings, a generally ridge-shaped top face of the piston 6 has a recess 24 having an inverted dome-like contour which extends from a site below the fuel injection valve 22 to a site below the ignition plug 20.

As shown in FIG. 1, the first intake ports 14*a* of the cylinders 2*a* are connected to a surge tank 32 via first intake passages 30*a* formed in an intake manifold 30. The second intake ports 14*b* are connected to the surge tank 32 via second intake passages 30*b*. An airflow control valve 34 is disposed within each second intake passage 30*b*. The airflow control valves 34 are interconnected via a common shaft 36, and are opened and closed via the shaft 36 by a negative pressure actuator 37. When the airflow control valves 34 are closed, intake air introduced via only the first intake ports 14*a* form strong swirls s (FIG. 3) within the combustion chambers 10.

The surge tank 32 is connected to an air cleaner 42 via an intake duct 40. A throttle valve 46 driven by an electric motor 44 (a DC motor or a step motor) is disposed in the intake duct 40. The degree of opening of the throttle valve 46 (degree of throttle opening TA) is detected by a throttle opening sensor 46*a*. The degree of opening of the throttle valve 46 is controlled in accordance with the operating state. The exhaust ports 18 of the cylinders 2*a* are connected to an exhaust manifold 48. The exhaust manifold 48 discharges exhaust gas, via a catalytic converter 49 for emission control.

Figure 7:
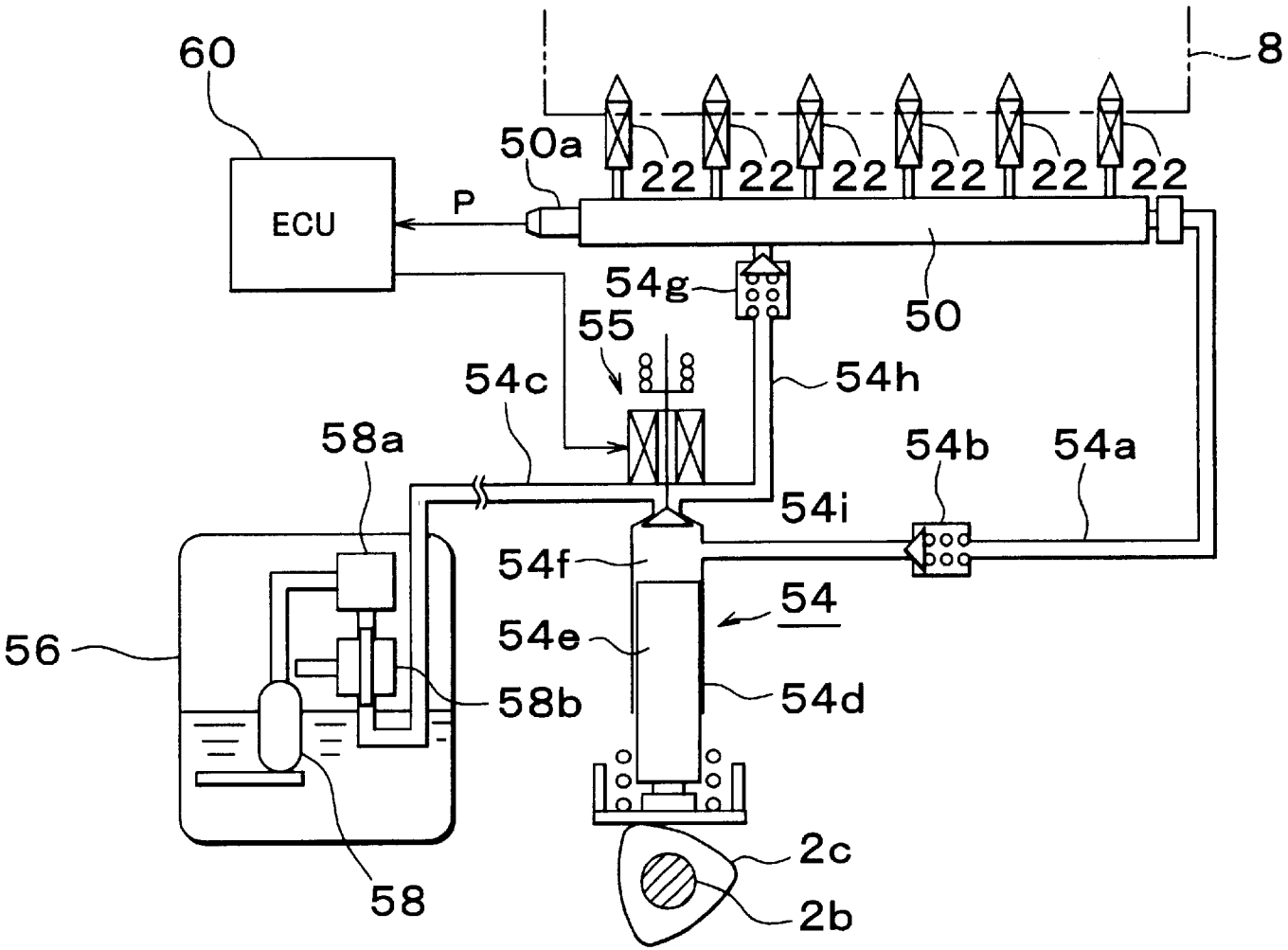
FIG. 7 is a diagram illustrating the construction of a fuel supply system in Embodiment 1.

FIG. 7 illustrates a construction of a fuel supply system for supplying high-pressure fuel toward the fuel injection valves 22. As shown in FIG. 7, a fuel distribution pipe 50 is provided in a portion of the cylinder head 8 located near the first intake valves 12*a* and the second intake valves 12*b*. The fuel distribution pipe 50 is connected to the fuel injection valve 22 of each cylinder 2*a*. Fuel supplied from the fuel distribution pipe 50 is injected from the fuel injection valves 22 directly into the corresponding combustion chambers 10.

The fuel distribution pipe 50 for distributing fuel to the fuel injection valves 22 is connected to a high-pressure fuel pump 54 via a high-pressure fuel passage 54*a*. The high-pressure fuel passage 54*a* is provided with a check valve 54*b* that restricts reverse flow of fuel from the fuel distribution pipe 50 toward the high-pressure fuel pump 54. A feed pump 58 provided within a fuel tank 56 is connected to the high-pressure fuel pump 54 via a low-pressure fuel passage 54*c*.

The feed pump 58 draws fuel present in the fuel tank 56 and ejects fuel toward the low-pressure fuel passage 54*c*, thereby delivering fuel into a gallery 54*i* of the high-pressure fuel pump 54 via a filter 58*a* and a pressure regulator 58*b*.

The high-pressure fuel pump 54 is mounted on a cylinder head cover (not shown) that covers an upper portion of the cylinder head 8. A plunger 54*e* is reciprocated within a pump cylinder 54*d* of the high-pressure fuel pump 54, by rotation of a pump cam 2*c* provided on a cam shaft 2*b* of the intake valves or exhaust valves of the engine 2. Due to the reciprocating movements of the plunger 54*e*, the high-pressure fuel pump 54 operates as follows. That is, during the suction stroke during which the capacity of a high-pressure pump chamber 54*f* increases, the high-pressure fuel pump 54 sucks fuel into the high-pressure pump chamber 54*f* from the side of low-pressure fuel passage 54*c* via the gallery 54*i*. During the pressurization stroke during which the capacity of the high-pressure pump chamber 54*f* decreases, the high-pressure fuel pump 54 delivers fuel pressurized in the high-pressure pump chamber 54*f* to the side of the fuel distribution pipe 50 via the high-pressure fuel passage 54*a* at a needed timing.

An electromagnetic spill valve 55 is provided within the high-pressure fuel pump 54. The electromagnetic spill valve 55 is an open-close valve for connecting and disconnecting the gallery 54*i* and the high-pressure pump chamber 54*f* in communication. While the electromagnetic spill valve 55 is open, the gallery 54*i* and the high-pressure pump chamber 54*f* are connected in communication. Therefore, fuel drawn into the high-pressure pump chamber 54*f* spills to the side of the low-pressure fuel passage 54*c* via the gallery 54*i* during the pressurization stroke. Thus, while the electromagnetic spill valve 55 is open, fuel is not pressurized, and is not delivered toward the fuel distribution pipe 50 via the high-pressure fuel passage 54*a*.

In contrast, when the electromagnetic spill valve 55 is closed, the communication between the gallery 54*i* and the high-pressure pump chamber 54*f* is shut off. Therefore, during the pressurization stroke, fuel in the high-pressure pump chamber 54*f* does not spill into the gallery 54*i*, but is pressurized to a high pressure by the pressing movement of the plunger 54*e*. Therefore, the check valve 54*b* is opened, so that high-pressure fuel is delivered toward the fuel distribution pipe 50 via the high-pressure fuel passage 54*a*.

An electronic control unit (hereinafter, referred to as "ECU") 60 controls the open-close timing of the electromagnetic spill valve 55 with reference to the fuel pressure P detected by a fuel pressure sensor 50*a* attached to the fuel distribution pipe 50 and the amount of fuel injection Q separately controlled by the ECU 60. Thus, the ECU 60 is able to adjust the amount of fuel delivered from the high-pressure fuel pump 54 toward the fuel distribution pipe 50, and is also able to adjust the fuel pressure P in the fuel distribution pipe 50 to a needed pressure.

A discharge path 54*h* having a relief valve 54*g* is connected to the fuel distribution pipe 50. If the fuel pressure P in the fuel distribution pipe 50 exceeds a set valve opening pressure due to an excessive supply of fuel to the side of the fuel distribution pipe 50, the relief valve 54*g* is opened to discharge an excess amount of fuel toward the discharge path 54*h*, and thereby keeps the fuel pressure in the fuel distribution pipe 50 at or below the set valve opening pressure. The fuel discharged toward the discharge path 54*h* is returned toward the gallery 54*i*. Thus, the fuel supply system is formed as a return-less fuel supply system in which an excess amount of fuel on the side of the fuel distribution pipe 50 is not returned directly to the fuel tank 56.

In the return-less fuel supply system, the fuel pressure in a passage from the discharge path 54*h* to the low-pressure fuel passage 54*c* tends to rise when fuel is returned from the side of the fuel distribution pipe 50 to the discharge path 54*h*. When the fuel pressure in the low-pressure system tends to rise, the pressure regulator 58*b* in the fuel tank 56 becomes opened. Therefore, of the amount of fuel present within the low-pressure fuel passage 54*c*, an amount of fuel present near the pressure regulator 58*b*, that is, an amount of fuel just pumped up from the fuel tank 56 by the feed pump 58, is returned from the pressure regulator 58*b* into the fuel tank 56. Thus, a rise in the fuel pressure in the low-pressure system extending from the discharge path 54*h* to the low-pressure fuel passage 54*c* is prevented. Furthermore, since the amount of fuel returned into the fuel tank 56 is the amount of fuel just pumped up from the fuel tank 56, a temperature increase in the fuel tank 56 can be prevented.

As shown in FIG. 2, the ECU 60 is formed by a digital computer that has a CUP (microprocessor) 60*b*, a ROM (read-only memory) 60*c*, a RAM (random access memory), a backup RAM 60*e*, an input circuit 60*f*, and an output circuit 60*g* that are interconnected by a bidirectional bus 60*a*.

The throttle opening sensor 46*a* for detecting the degree of throttle opening TA inputs to the input circuit 60*f* an output voltage proportional to the degree of opening TA of the throttle valve 46. An accelerator pedal 74 is provided with an accelerator depression sensor 76 that inputs to the input circuit 60*f* an output voltage proportional to the amount ACCP of depression of the accelerator pedal 74. A stop lamp switch 80 for detecting a state of depression of a brake pedal 78 inputs a stop lamp switch signal SLSW to the input circuit 60*f*. A revolution sensor 82 generates an output pulse at every 30° rotation of a crankshaft (not shown), and inputs the output pulse to the input circuit 60*f*. A cylinder discrimination sensor 84 generates an output pulse when, for example, a No. 1 cylinder of the cylinders 2*a* reaches the intake top dead center, and inputs the output pulse to the input circuit 60*f*. The CPU 60*b* calculates a present crank angle based on output pulses from the cylinder discrimination sensor 84 and output pulses from the revolution sensor 82, and calculates an engine revolution speed NE based on the frequency of output pulses from the revolution sensor 82.

The cylinder block 4 of the engine 2 is provided with a water temperature sensor 86. The water temperature sensor 86 detects the temperature THW of cooling water of the engine 2, and inputs to the input circuit 60*f* an output voltage corresponding to the cooling water temperature THW. The surge tank 32 is provided with an intake pressure sensor 88. The intake pressure sensor 88 inputs to the input circuit 60*f* an output voltage corresponding to the intake pressure (pressure of intake air (absolute pressure)) PM in the surge tank 32. The exhaust manifold 48 is provided with an air-fuel ratio sensor 90. The air-fuel ratio sensor 90 inputs to the input circuit 60*f* an output voltage Vox in accordance with the air-fuel ratio. The fuel pressure sensor 50*a* provided on the fuel distribution pipe 50 inputs to the input circuit 60*f* an output voltage in accordance with the fuel pressure P in the fuel distribution pipe 50. A voltage VB of a battery 92 installed in the vehicle is inputted to the input circuit 60*f*. Furthermore, an output side of the transmission apparatus (not shown) is provided with a vehicle speed sensor 94. The vehicle speed sensor 94 inputs to the input circuit 60*f* a signal generated in accordance with the vehicle speed SPD based on rotation of an output shaft of the transmission.

The output circuit 60*g* is connected to the fuel injection valves 22, the negative pressure actuator 37, the drive motor 44 for the throttle valve 46, the electromagnetic spill valve 55, an igniter 100, and a starter motor 102, and drives and controls the actuator units 22, 37, 45, 55, 100, 102 in accordance with needs.

Figure 8:
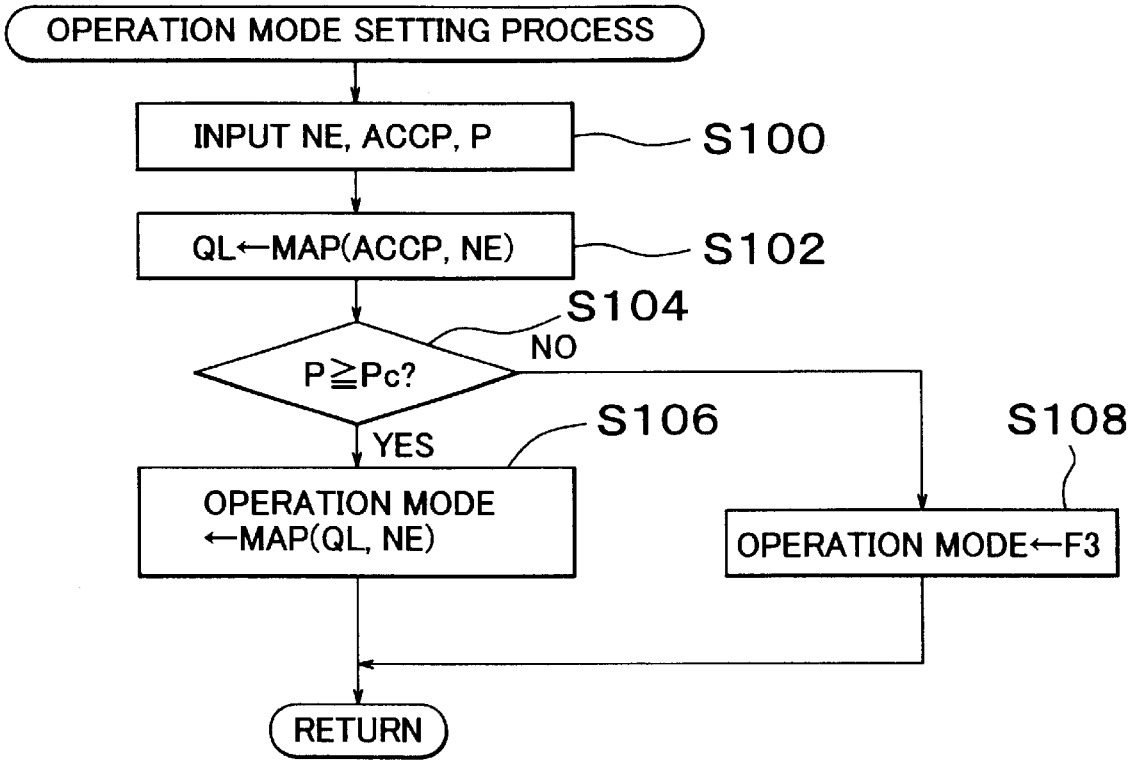
FIG. 8 is a flowchart illustrating an operation mode setting process in Embodiment 1.

A fuel injection control performed after the engine 2 has been started will next be described. The flowchart of FIG. 8 illustrates a process of setting a mode of operation needed for the fuel injection control. This process is periodically executed at every pre-set crank angle. The individual process steps in the flowchart described below will be referred to as "S".

In S100, the engine revolution speed NE acquired from the signal from the revolution sensor 82, the amount of depression of the accelerator pedal 74 (hereinafter, referred to as "accelerator pedal depression") ACCP acquired from the signal from the accelerator depression sensor 76, and the fuel pressure P acquired from the signal from the fuel pressure sensor 50*a* are inputted into work areas of the RAM 60*d*.

Figure 9:
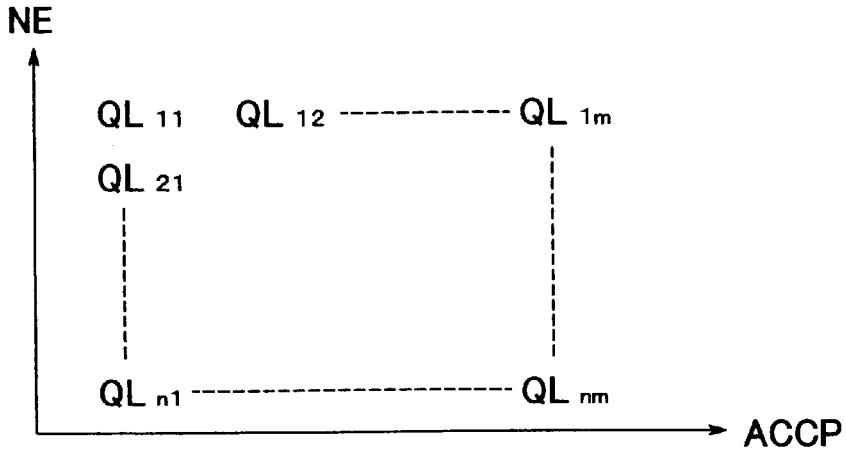
FIG. 9 is a diagram illustrating the construction of a map for determining a lean fuel injection amount QL in Embodiment 1.

Subsequently in S102, a lean fuel injection amount QL is calculated based on the engine revolution speed NE and the accelerator pedal depression ACCP. The lean fuel injection amount QL represents an optimal fuel injection amount for bringing the output toque of the engine 2 to a requested torque during performance of stratified charge combustion. The lean fuel injection amount QL is empirically determined, and is pre-stored in the ROM 60*c* in the form of a map that employs the accelerator pedal depression ACCP and the engine revolution speed NE as parameter as indicated in FIG. 9. In S102, the lean fuel injection amount QL is calculated based on the aforementioned map. In the map, values are discretely arranged. Therefore, if there is no value that matches as a parameter, a suitable value is determined by interpolation. This manner of determining a value from the map through interpolation is likewise performed in determining values from maps other than the aforementioned map, as well.

Subsequently in S104, it is determined whether the actually measured fuel pressure P is at least a reference pressure Pc, that is, whether the actually measured fuel pressure P is a fuel pressure that sufficiently allows fuel injection during the compression stroke for the purpose of stratified charge combustion.

Figure 10:
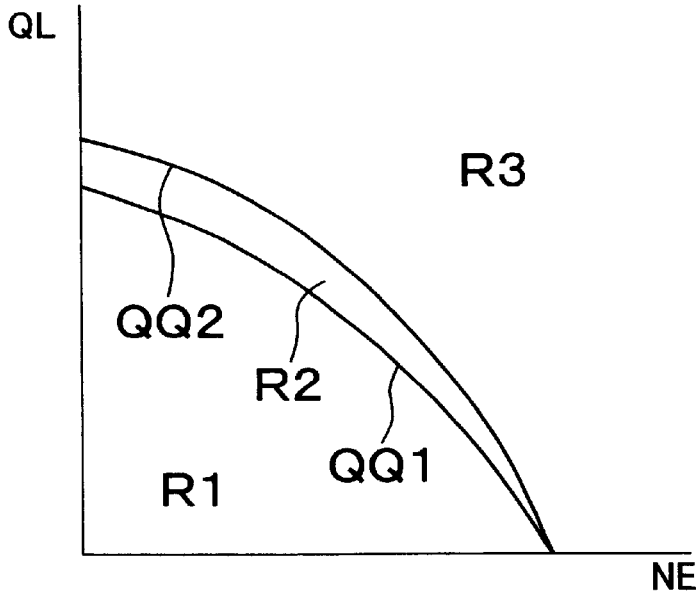
FIG. 10 is a diagram illustrating the construction of a map for setting a mode of operation in Embodiment 1.

If "YES" in S104, that is, if $P \geqq Pc$, it is possible to perform sufficient fuel injection during the compression stroke. Then, the process proceeds to S106. In S106, based on the lean fuel injection amount QL and the engine revolution speed NE, an operation mode is set corresponding to one of three regions R1, R2, R3 as indicated in the map of FIG. 10. After that, the process is temporarily ended. The map of FIG. 10 is prepared beforehand by empirically setting suitable modes of operation in accordance with the lean fuel injection amount QL and the engine revolution speed NE. The map is stored in the ROM 60*c* as a map that employs the lean fuel injection amount QL and the engine revolution speed NE as parameters.

Referring to FIG. 10, in the operation region R1 where the lean fuel injection amount QL and the engine revolution speed NE are less than a boundary line QQ1, a mode F1 is selected as a mode of operation. In the operation mode F1, an amount of fuel corresponding to the lean fuel injection amount QL is injected during a late period in the compression stroke. Injected fuel provided by injected performed during the late period of the compression stroke moves from the fuel injection valve 22 into the recess 24 of the piston 6 in each cylinder, and then strikes a peripheral wall surface 26 (FIGS. 4, 5). Upon striking the peripheral wall surface 26, fuel vaporizes and forms a combustible mixture layer in the recess 24 adjacent to the ignition plug 20. The stratified combustible mixture is ignited by the ignition plug 20, thereby accomplishing stratified charge combustion. In this manner, stable combustion can be accomplished in the combustion chambers with intake air existing in an extremely excess amount relative to fuel.

In the operation region R2 where the lean fuel injection amount QL and the engine revolution speed NE are between the boundary line QQ1 and a boundary line QQ2, a mode F2 is selected as a mode of operation. In the operation mode F2, an amount of fuel corresponding to the lean fuel injection amount QL is injected dividedly twice, that is, once during the intake stroke and once during the late period of the compression stroke. That is, the first fuel injection is performed during the intake stroke, and the second fuel injection is performed during the late period of the compression stroke. The first injected fuel flows together with intake air into the combustion chamber 10, and thereby forms a uniform lean mixture in the entire space of the combustion chamber 10. Furthermore, as a result of the second fuel injection performed during the late period of the compression stroke, a combustible mixture layer is formed within the recess 24 adjacent to the ignition plug 20 as described above. The stratified combustible mixture is ignited by the ignition plug 20, and the ignited flame burns the lean mixture filling the entire combustion chamber 10. That is, in the operation mode F2, stratified charge combustion is performed at a reduced degree of stratification in comparison with the operation mode F1. In this manner, smooth torque changing can be realized in an intermediate region between the operation region R1 and the operation region R3.

In the operation region R3 where the lean fuel injection amount QL and the engine revolution speed NE are greater than the boundary line QQ2, a mode F3 is set as a mode of operation. In the operation mode F3, the amount of fuel corrected in various manners based on a stoichiometric air-fuel ratio basic fuel injection amount QBS is injected during the intake stroke. The thus-injected fuel enters the combustion chamber 10 together with an inflow of intake air, and moves until ignition. This flowing movement forms a uniform mixture that uniformly exists in the entire combustion chamber 10 at the stoichiometric air-fuel ratio (in some cases, the air-fuel ratio is controlled to a rich air-fuel ratio that means a higher fuel concentration than the stoichiometric air-fuel ratio, due to an increasing control as described below). As a result, uniform combustion is accomplished. Conversely, if "NO" in S104, that is, if $P<Pc$, the low fuel pressure P makes it impossible to perform sufficient fuel injection during the compression stroke. Then, the process proceeds to S108, in which the mode F3 is set as a mode of operation. The process is then temporarily ended.

Figure 11:
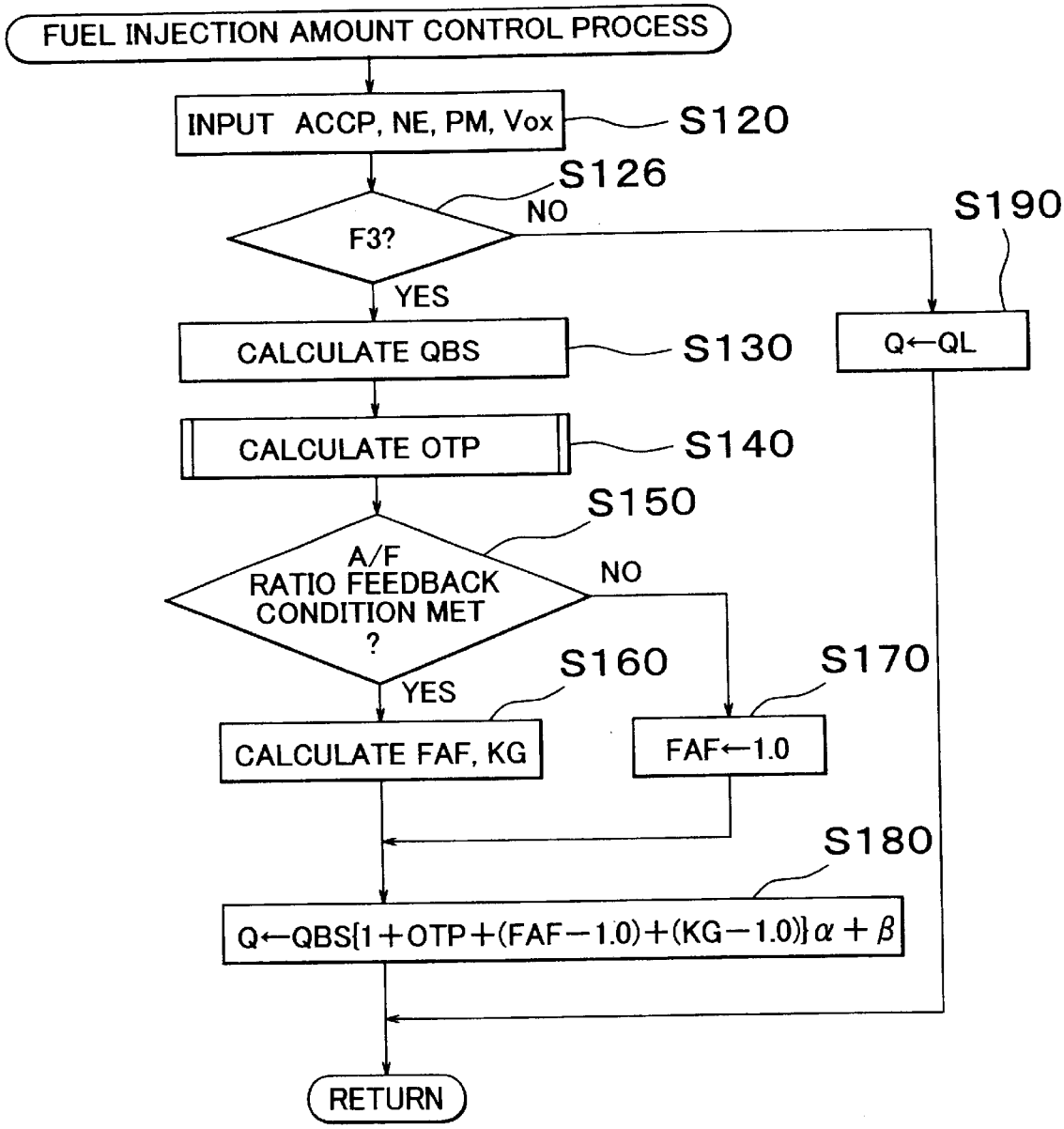
FIG. 11 is a flowchart illustrating a fuel injection amount control process in Embodiment 1.

FIG. 11 shows a flowchart of a fuel injection amount control process that is executed based on the mode of operation set by the above-described operation mode setting process. The process illustrated in FIG. 11 is periodically executed at every pre-set crank angle.

After the fuel injection amount control process starts, the accelerator pedal depression ACCP acquired from the signal from the accelerator depression sensor 76, the engine revolution speed NE acquired from the signal from the revolution sensor 82, the intake pressure PM acquired from the signal from the intake pressure sensor 88, and the detected air-fuel ratio value Vox acquired from the signal from the air-fuel ratio sensor 90 are inputted to work areas of the RAM 60*d* in S120.

Figure 12:
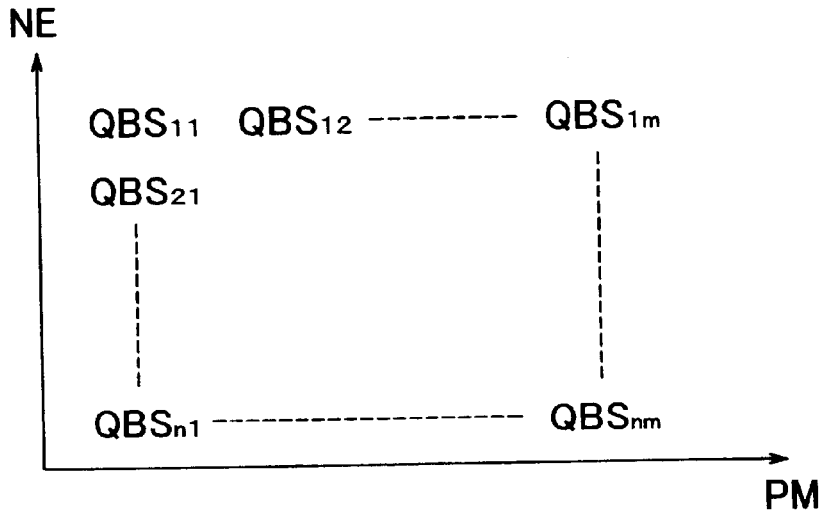
FIG. 12 is a diagram illustrating the construction of a map for determining a stoichiometric air-fuel ratio basic fuel injection amount QBS in Embodiment 1.

Subsequently in S126, it is determined whether the operation mode F3 has been set by the operation mode setting process illustrated in FIG. 8. If "YES" in S126, that is, if it is determined that the operation mode F3 has been set, the process proceeds to S130. In S130, a stoichiometric air-fuel ratio basic fuel injection amount QBS is calculated from the intake pressure PM and the engine revolution speed NE, using a map of FIG. 12 pre-set in the ROM 60*c*.

Figure 13:
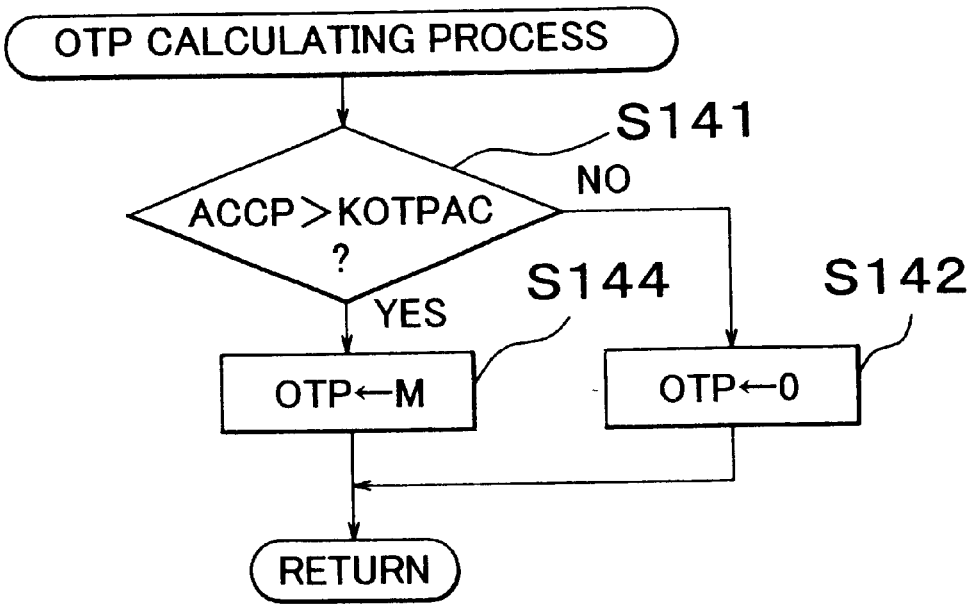
FIG. 13 is a flowchart illustrating a high-load increase amount OTP calculating process executed in Embodiment 1.

Subsequently in S140, a high-load increase amount OTP calculating process is executed. The high-load increase amount OTP calculating process will be described with reference to the flowchart of FIG. 13. In the high-load increase amount OTP calculating process, first in S141, it is determined whether the accelerator pedal depression ACCP is greater than a high-load increase amount criterion KOTPAC. If "NO" in S141, that is, if ACCP≦KOTPAC, the process proceeds to S142, in which a value "0" is set as the high-load increase amount OTP. This means that the fuel increasing correction is not performed. Then, the high-load increase amount OTP calculating process is temporarily ended. Conversely, if "YES" in S141, that is, if ACCP>KOTPAC, the process proceeds to S144, in which a value M (e.g., 1>M>0) is set as the high-load increase amount OTP. Thus, execution of the fuel increase correction is set. This increasing correction is performed in order to prevent the overheating of the catalytic converter 49 during a high-load operation.

Referring back to FIG. 11, after the high-load increase amount OTP is calculated in S140, the process proceeds to S150, in which it is determined whether an air-fuel ratio feedback condition is met. For example, it is determined whether all the following conditions are met: (1) the engine is not being started; (2) warm-up has been completed (e.g., cooling water temperature THW≧40° C.); (3) the air-fuel ratio sensor 90 has been activated; and (4) the value of the high-load increase amount OTP is "0".

If "YES" in S150, that is, if the air-fuel ratio feedback condition is met, the process proceeds to S160, in which an air-fuel ratio feedback factor FAF and a learned value KG thereof are calculated. The air-fuel ratio feedback factor FAF is calculated based on the output of the air-fuel ratio sensor 90. The learned value KG is provided for storing a deviation of the air-fuel ratio feedback factor FAF from a center value "1.0". With regard to the air-fuel ratio feedback control technology employing the aforementioned values, various techniques are known as disclosed in Japanese Patent Application Laid-Open No. HEI 6-10736 and the like.

Conversely, if "NO" in S150, that is, if the air-fuel ratio feedback condition is not met, the process proceeds to S170, in which the air-fuel ratio feedback factor FAF is set to 1.0. After S160 or S170, the process proceeds to S180, in which an amount of fuel injection Q is determined as in Equation 1.

$$Q \rightarrow QBS\{1+OTP+(FAF-1.0)+(KG-1.0)\}\alpha+\beta \qquad \text{[Eq. 1]}$$

where α and β are factors that are suitably set in accordance with the kind of the engine 2, the content of control, etc.

After that, the fuel injection amount control process is temporarily ended.

If "NO" in S126, that is, if the present operation mode is other than the operation mode F3, that is, either one of the operation modes F1 and F2, the process proceeds to S190. In S190, the lean fuel injection amount QL determined in S102 in the operation mode setting process (FIG. 8) is set as an amount of fuel injection Q. After that, the fuel injection amount control process is temporarily ended.

Figure 14:
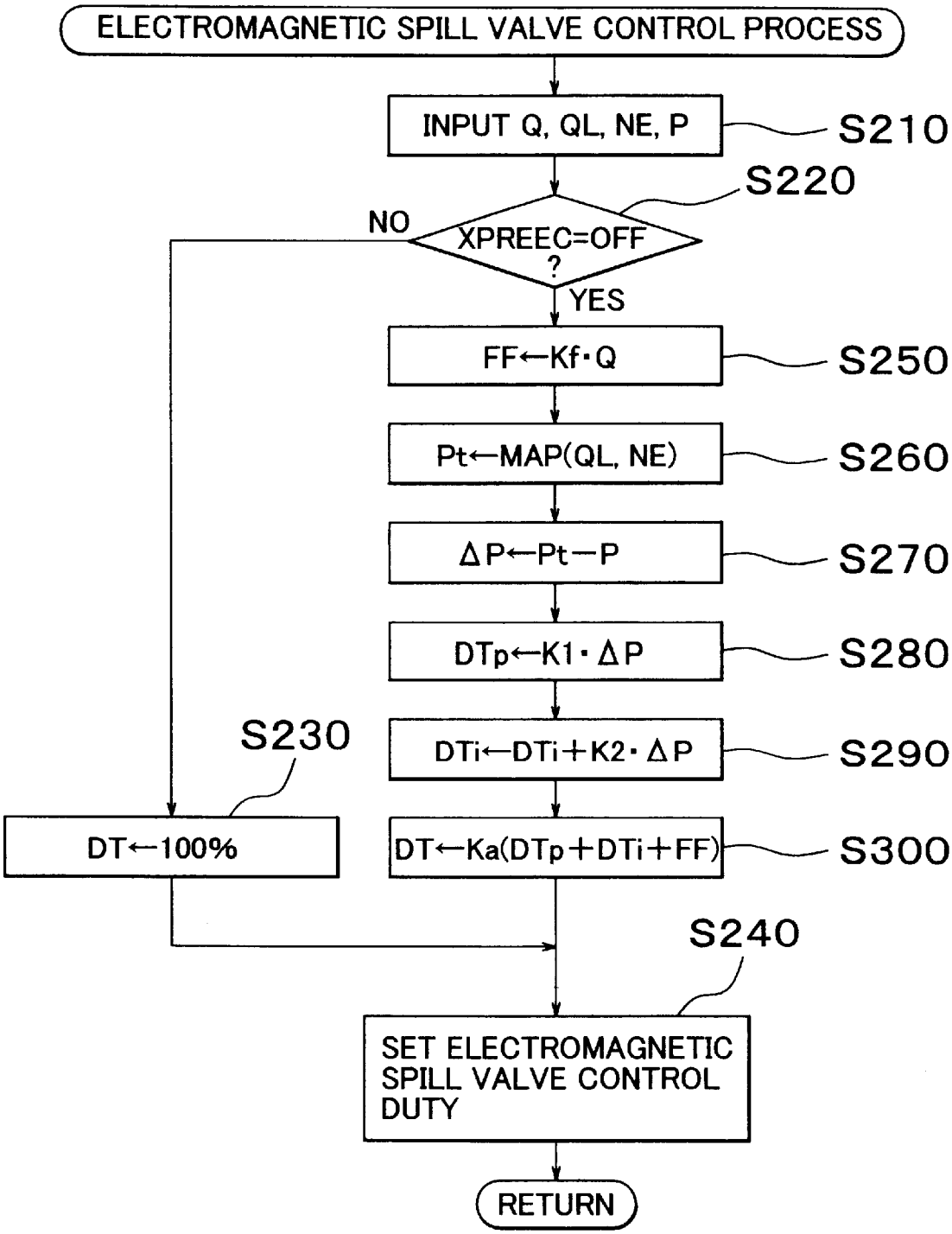
FIG. 14 is a flowchart illustrating an electromagnetic spill valve control process in Embodiment 1.

An electromagnetic spill valve control process for controlling the amount of fuel delivered from the high-pressure fuel pump 54 to the fuel distribution pipe 50 will be described with reference to the flowchart of FIG. 14. This process is periodically executed at every pre-set crank angle.

After the electromagnetic spill valve control process starts, the amount of fuel injection Q calculated in the fuel injection amount control process illustrated in FIG. 11, the lean fuel injection amount QL calculated as a value corresponding to the engine load in S102 of the operation mode setting process illustrated in FIG. 8, the engine revolution speed NE detected by the revolution sensor 82, and the fuel pressure P in the fuel distribution pipe 50 detected by the fuel pressure sensor 50*a* are inputted to work areas of the RAM 60*d* in S210.

Subsequently in S220, it is determined whether an immediately-before-automatic-stop flag XPREEC related to the engine 2 is "OFF". The immediately-before-automatic-stop flag XPREEC is a flag that is turned "ON" immediately before the automatic stop is performed after the automatic stop condition is met, as described below.

Figure 15:
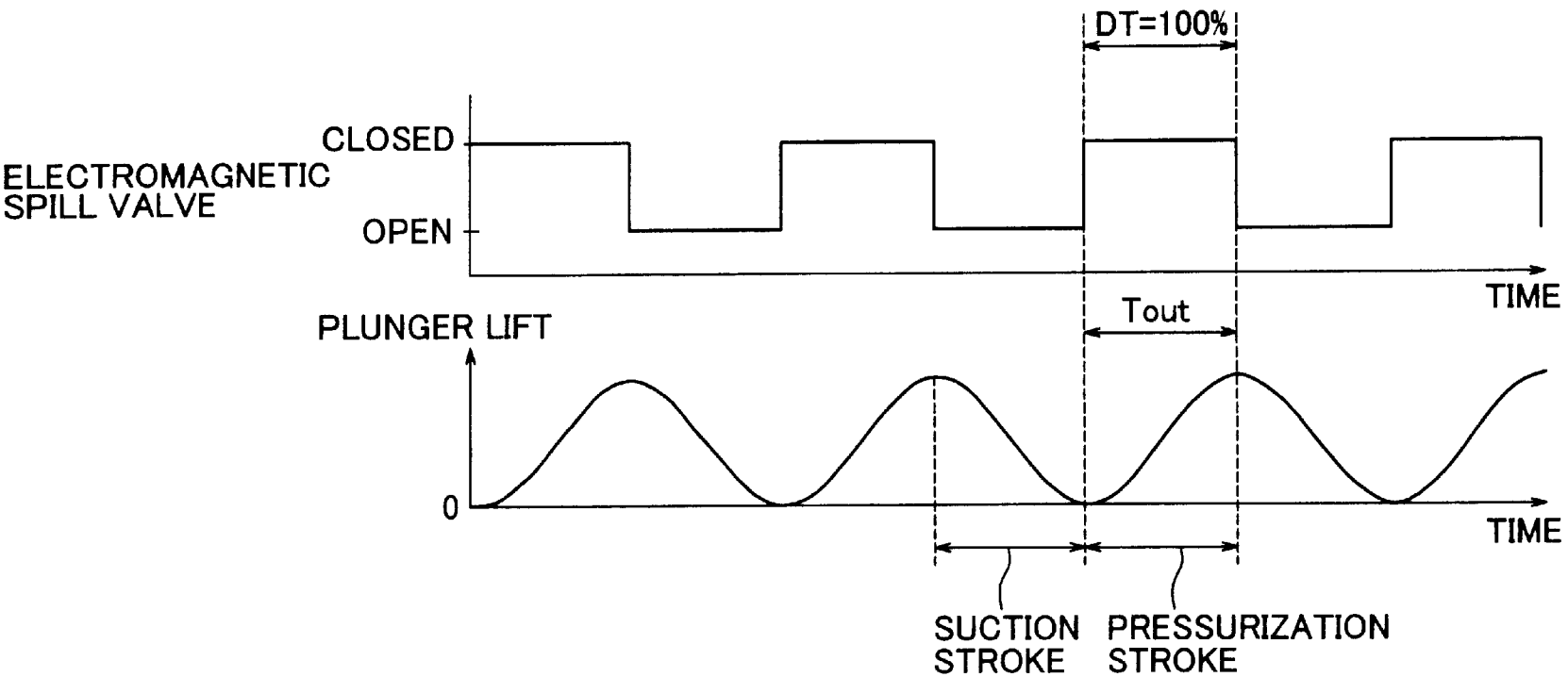
FIG. 15 is a timing chart illustrating an example of the electromagnetic spill valve control in Embodiment 1.

If "NO" in S220, that is, if XPREEC="ON", the process proceeds to S230, in which a control duty DT that sets a closed valve duration (delivery duration) of the electromagnetic spill valve 55 is set to "100%". The control duty DT represents the proportion of the closed duration of the electromagnetic spill valve 55 to the entire duration of the pressurization stroke of the high-pressure fuel pump 54, during which the capacity of the high-pressure pump chamber 54*f* is decreased by the plunger 54*e*. As indicated in FIG. 15, DT=100% means that the electromagnetic spill valve 55 remains closed during the entire pressurization stroke, and therefore, the entire duration of the pressurization stroke is an ejection duration Tout of ejection from the high-pressure fuel pump 54 toward the fuel distribution pipe 50. That is, the control duty DT=100% represents a state in which the amount of delivery from the high-pressure fuel pump 54 is adjusted to a maximum.

Subsequently in S240, the aforementioned control duty DT is set as a control duty that represents the closed valve duration of the electromagnetic spill valve 55 during the pressurization stroke of the high-pressure fuel pump 54. After that, the electromagnetic spill valve control process is temporarily ended.

In the case of XPREEC="ON", the amount of delivery from the high-pressure fuel pump 54 to the fuel distribution pipe 50 reaches a maximum, and the fuel pressure P in the fuel distribution pipe 50 rapidly rises. If this state continues, the fuel pressure P reaches a set valve opening pressure of the relief valve 54*g* (e.g., 14.0 to 14.5 MPa), so that fuel starts to be discharged via the relief valve 54*g* into the discharge path 54*h*.

If "YES" in S220, that is, if XPREEC="OFF", the process proceeds to 5250, in which a feed-forward term FF is calculated based on the product (Kf·Q) of the amount of fuel injection Q and a feed-forward factor Kf.

Figure 16:
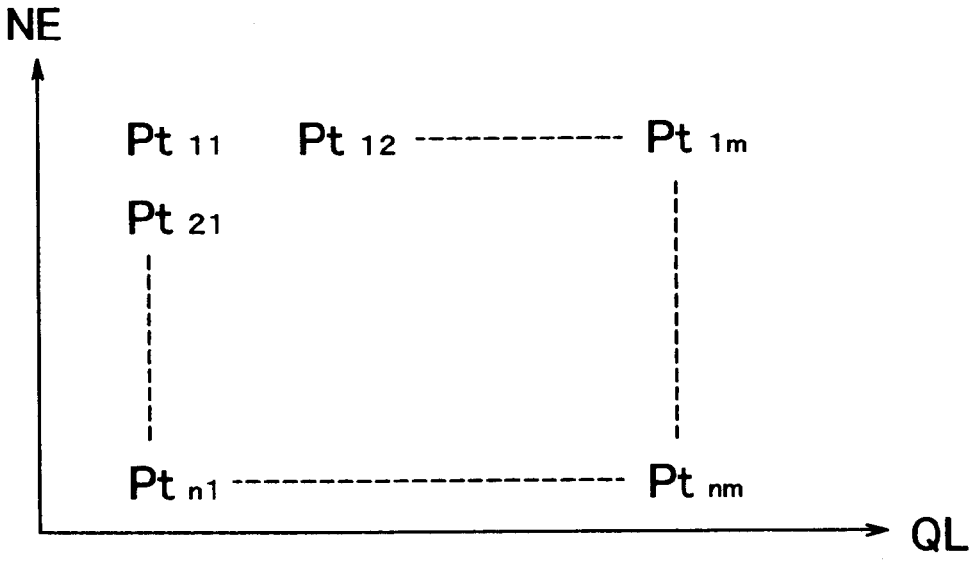
FIG. 16 is a diagram illustrating the construction of a map for determining a target fuel pressure Pt in Embodiment 1.

Subsequently in S260, a target fuel pressure Pt is calculated by using a map that employs, as parameters, the engine revolution speed NE and the lean fuel injection amount QL corresponding to the engine load as indicated in FIG. 16. This map is pre-set by determining target fuel pressures Pt indicating a suitable fuel injection state, in accordance with the lean fuel injection amount QL and the engine revolution speed NE based on an experiment. The map is stored in the ROM 60*c*.

Subsequently in S270, a pressure deviation ΔP between the target fuel pressure Pt and the actual fuel pressure P is calculated as in Equation 2.

$$\Delta P \rightarrow Pt - P \quad \text{[Eq. 2]}$$

Subsequently in S280, a proportional term DTp is calculated from the product of the pressure deviation ΔP and a proportionality factor K1. Subsequently in S290, an integral term DTi is calculated based on the product (K2·ΔP) of the pressure deviation ΔP and an integration factor K2, as in Equation 3.

$$DTi \rightarrow DTi + K2 \cdot \Delta P \quad \text{[Eq. 3]}$$

In Equation 3, "DTi" on the right-hand side represents the integral term DTi calculated during the previous control cycle, and the initial value thereof is set to, for example, "0".

Subsequently in S300, a control duty DT for setting the closed valve duration (delivery duration) of the electromagnetic spill valve 55 is calculated as in Equation 4.

$$DT \rightarrow Ka(DTp + DTi + FF) \quad \text{[Eq. 4]}$$

where Ka is a correction factor.

After the control duty DT is thus determined, this control duty DT is set in S240 as a control duty that represents the closed valve duration of the electromagnetic spill valve 55 during the pressurization stroke of the high-pressure fuel pump 54. After that, the process is temporarily ended.

If "YES" in S220, that is, if the immediately-before-automatic-stop flag XPREEC is "OFF" as mentioned above, the target fuel pressure Pt calculated in S260 is set to an appropriate value within the range of, for example, 8.0 to 13.0 MPa.

Figure 17:
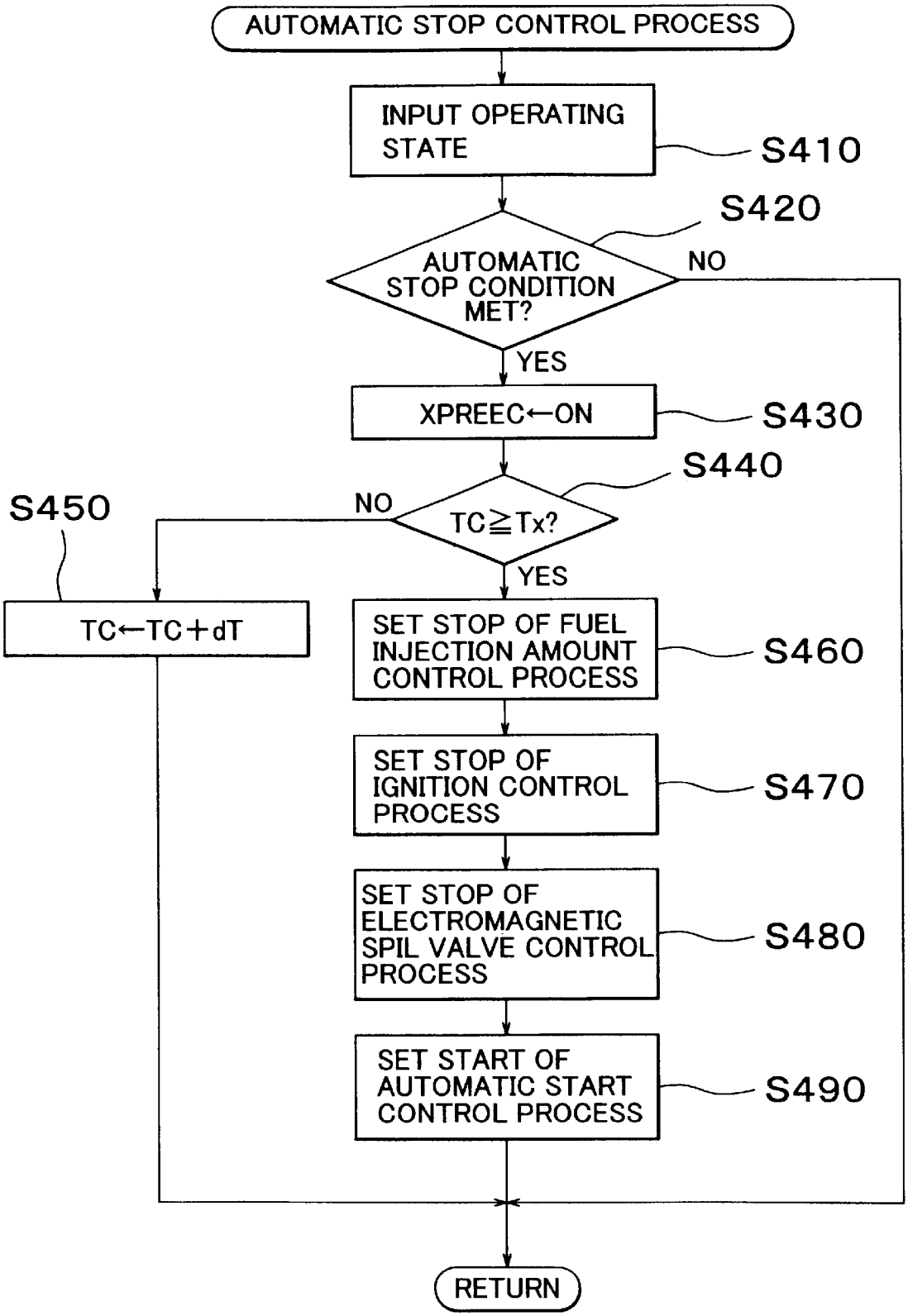
FIG. 17 is a flowchart illustrating an automatic stop control process in Embodiment 1.

Next, the automatic stop control process is illustrated in the flowchart of FIG. 17. This process is periodically executed at every pre-set short time. In this process, the setting of the aforementioned immediately-before-automatic-stop flag XPREEC is performed as well as the automatic stop control process of the engine 2.

When the automatic stop control process starts, the operating state for determining whether to execute the automatic stop is inputted in S410. For example, the cooling water temperature THW detected by the water temperature sensor 86, the presence/absence of a depression of the accelerator pedal 74 detected by the accelerator depression sensor 76, the voltage VB of the battery 92, the presence/absence of a depression of the brake pedal 78 detected from the stop lamp switch signal SLSW from the stop lamp switch 80, and the vehicle speed SPD detected from the signal from the vehicle speed sensor 94 are inputted to work areas of the RAM 60*d*.

Subsequently in S420, it is determined from the operating states whether an automatic stop condition is met. It is determined that the automatic stop condition is met, if, for example, all the following conditions are met: (1) the engine 2 has been warmed up and is not overheated (the cooling water temperature THW is lower than a water temperature upper limit value THWmax, and is higher than a water temperature lower limit value THWmin); (2) the accelerator pedal 74 is not depressed (the accelerator pedal depression ACCP=0°); (3) the amount of charge in the battery 92 is at least a certain amount (the voltage VB is at least a reference voltage); (4) the brake pedal 78 is depressed (the stop lamp switch signal SLSW is "ON"); and (5) the vehicle is stopped (the vehicle speed SPD is 0 km/h).

If "NO" in S420, that is, if any one of the aforementioned conditions (1) to (5) is unmet, it is determined that the automatic stop condition is not met. Then, the process is temporarily ended.

Conversely, if "YES" in S420, that is, if the automatic stop condition is met because, for example, the operating person stops the vehicle at an intersection or the like, the process proceeds to S430, in which the immediately-before-automatic-stop flag XPREEC is set to "ON". As a result, negative determination is made in S220 in the above-described electromagnetic spill valve control process illustrated in FIG. 14, and the control duty DT=100% is set in S230. Thus, the fuel pressure P is raised to an increased level in comparison with an ordinary operating state.

Subsequently in S440 of the automatic stop control process, it is determined whether a timer counter TC has reached or exceeded a pressure raise continuation duration Tx. If "NO" in S440, that is, if it is determined that TC<Tx, the process proceeds to S450, in which the counting-up of the timer counter TC is executed as expressed in Equation 5. After that, the process is temporarily ended.

$$TC \rightarrow TC + dT \quad \text{[Eq. 5]}$$

In Equation 5, dT is a control cycle of the automatic stop control process. That is, the timer counter TC measures time that elapses after the automatic stop condition is met. The pressure raise continuation duration Tx is a reference time provided for determining from elapse of time whether the raise of the fuel pressure P that needs to be accomplished immediately prior to the automatic stop has been completed. A value of the pressure raise continuation duration Tx is set by empirically determining a time needed for the fuel pressure P to sufficiently rise if the control duty DT=100(%) is set.

If "YES" in S420, that is, until the pressure raise continuation duration Tx elapses after the automatic stop condition has been met, the process of S410, S420, S430, S440, S450 is repeated. Therefore, XPREEC="ON" is maintained, and the state of control duty DT=100(%) with respect to the electromagnetic spill valve 55 continues. If "YES" in S440, that is, if TC≧Tx as a result of the counting up in S450, the process proceeds to S460, in which the setting for stopping the fuel injection amount control process illustrated in FIG. 11 is made. Subsequently in S470, the setting for stopping an ignition control process (not illustrated in detail) is made. As a result, the fuel injection and the ignition stop, so that the operation of the engine 2 immediately stops. Due to the stop of the engine 2, the driving of the high-pressure fuel pump 54 also stops, and the check valve 54*b* is closed. Therefore, the inside of the fuel distribution pipe 50 is tightly closed in a high-pressure fuel state achieved by raising the fuel pressure from an ordinary level (the pressure being not higher than the set valve opening pressure of the relief valve 54*g*) due to the control duty DT=100(%) immediately before the stop of the engine 2.

Subsequently in S480, the setting for a stop is also made with respect to the electromagnetic spill valve control process illustrated in FIG. 14, and the output of the control duty signal is stopped.

Subsequently in S490, a start of an automatic start control process described below is set. After that, the process is temporarily ended.

After the stop settings for the fuel injection amount control process, the ignition control process and the electromagnetic spill valve control process (S460, S470, S480) and the start setting for the automatic start control process (S490) have been made, the stopped states of the aforementioned controls and the execution of the automatic start control process continue until the start settings for the controls and the stop setting for the automatic start control process are made, even if negative determination is made ("NO") in S420, that is, even if the automatic stop condition is unmet.

Figure 18:
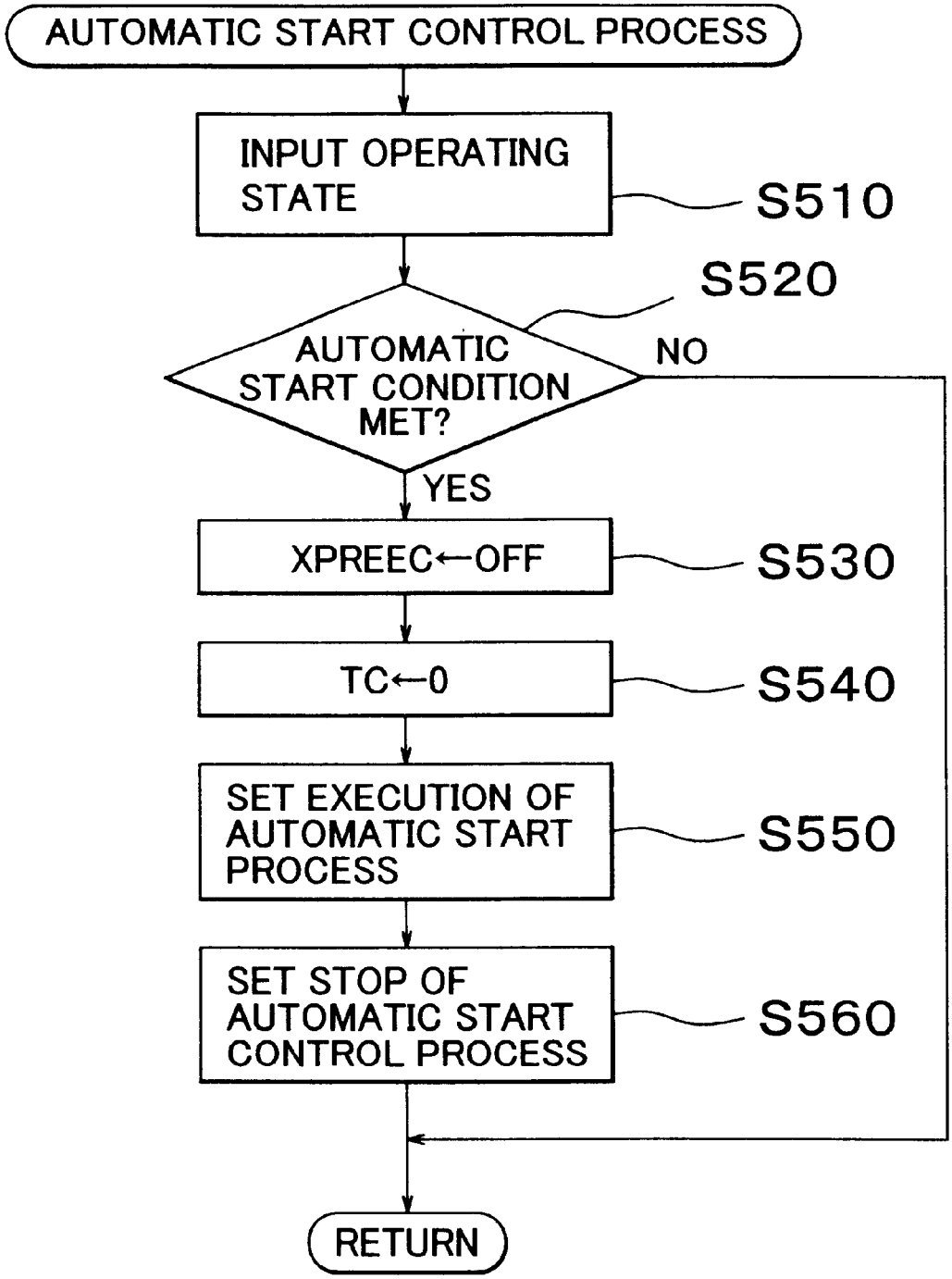
FIG. 18 is a flowchart illustrating an automatic start control process in Embodiment 1.

The automatic start control process is illustrated in the flowchart of FIG. 18. This process is periodically executed at every pre-set short time.

After the automatic start control process starts, the operating state of the engine 2 is inputted in S510 in order to determine whether to substantially execute the automatic start process. For example, similar to the data inputted in S410, the cooling water temperature THW, the accelerator pedal depression ACCP, the voltage VB of the battery 92, the stop lamp switch signal SLSW, and the vehicle speed SPD are inputted to work areas of the RAM 60*d*.

Subsequently in S520, it is determined from the operating states whether an automatic start condition is met. It is determined that the automatic start condition is met if, for example, any one of the following conditions (1) to (5) is unmet: (1) the engine 2 has been warmed up and is not overheated (the cooling water temperature THW is lower than the water temperature upper limit value THWmax, and is higher than the water temperature lower limit value THWmin); (2) the accelerator pedal 74 is not depressed (the accelerator pedal depression ACCP=0°); (3) the amount of charge in the battery 92 is at least a certain amount (the voltage VB is at least a reference voltage); (4) the brake pedal 78 is depressed (the stop lamp switch signal SLSW is "ON"); and (5) the vehicle is stopped (the vehicle speed SPD is 0 km/h). As for the automatic start condition, it is not altogether necessary to adopt the same conditions as the conditions (1) to (5) adopted for the automatic stop condition. That is, it is practicable to set conditions other than the conditions (1) to (5). It is also practicable to extract only some of the conditions (1) to (5).

If "NO" in S520, that is, if all the conditions (1) to (5) are met, it is determined that the automatic start condition is not met. After that, the process is temporarily ended.

Conversely, if "YES" in S520, that is, if any one of the conditions (1) to (5) is unmet, it is determined that the automatic start condition is met, and the process proceeds to S530. In S530, the immediately-before-automatic-stop flag XPREEC is set to "OFF". Subsequently in S540, the timer counter TC is cleared to zero.

Subsequently in S550, execution of the automatic start process is set. Upon setting for executing the automatic start process, the starter motor 102 is driven to turn the crankshaft of the engine 2, and the fuel injection amount control process and the ignition timing control process for an engine start are executed, so that the engine 2 is automatically started. After the starting is completed, the fuel injection amount control process illustrated in FIG. 11, the ignition control process (not illustrated), and the electromagnetic spill valve control process illustrated in FIG. 14, as well as other processes necessary for the driving of the engine 2, are started.

After the execution setting for the automatic start process is made, the stop setting for the automatic start control process is made in S560. As a result, the automatic start control process stops.

Figure 19:
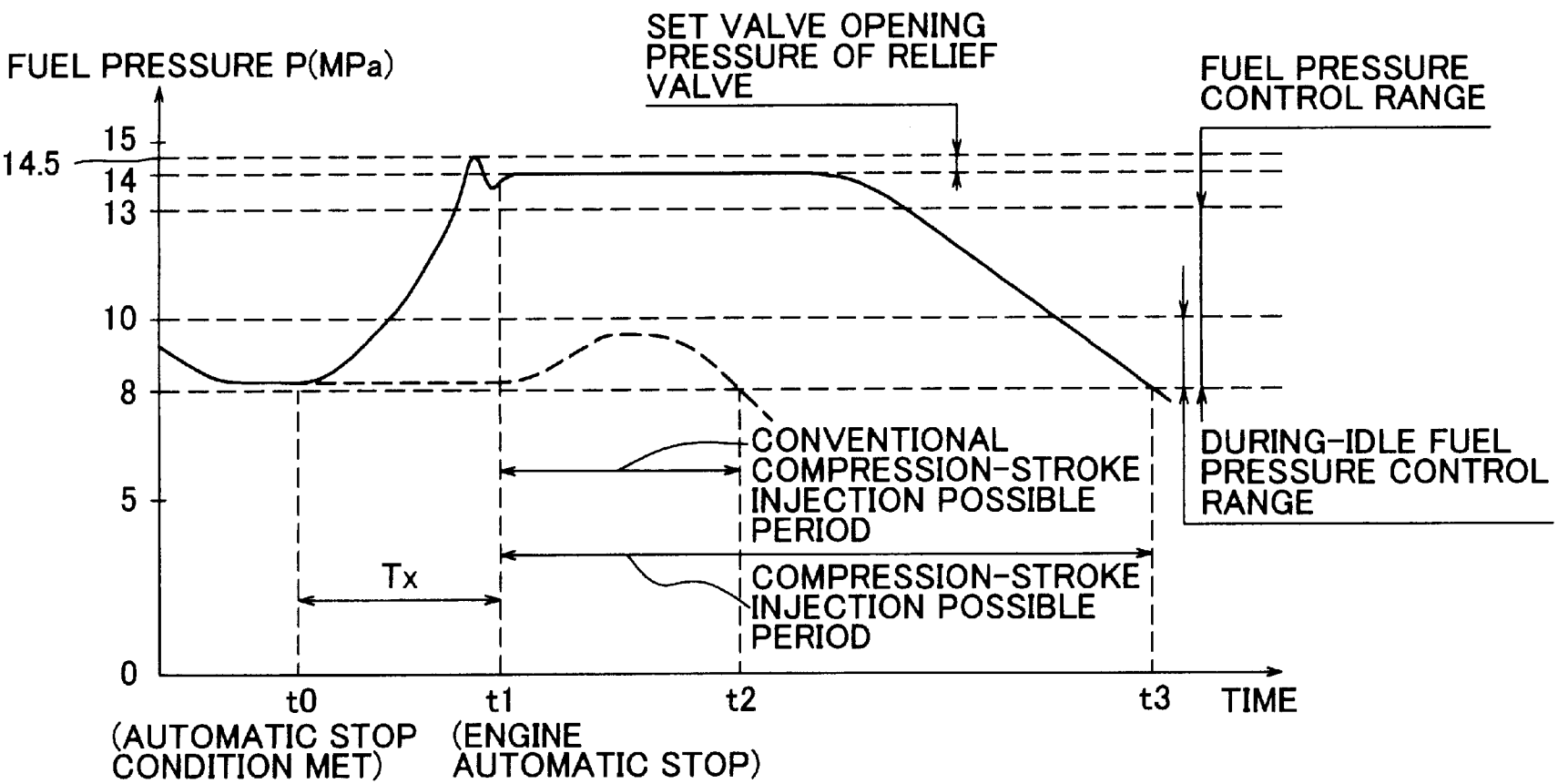
FIG. 19 is a timing chart illustrating an example of the control of the fuel pressure P in Embodiment 1.

The changing of the fuel pressure P in accordance with Embodiment 1 is illustrated in the timing chart of FIG. 19.

For example, when the operating person stops the vehicle and keeps it in an idling state at an intersection or the like, the automatic stop condition is met at time point t0. That is, if "YES" in S420, the process proceeds to S430, in which the immediately-before-automatic-stop flag XPREEC is set to "ON". As a result, in S220 and S230, the control duty DT of the electromagnetic spill valve 55 is set to 100%, and the fuel pressure P rapidly rises beyond a during-idle fuel pressure control range (8 to 10 MPa in this embodiment) as indicated by a solid line, and reaches the set valve opening pressure of the relief valve 54*g* (14 to 14.5 MPa in this embodiment). Therefore, the relief valve 54*g* temporarily opens to discharge an excess amount of fuel from the fuel distribution pipe 50 into the discharge path 54*h*. After that, in S460 and S470, the engine 2 is automatically stopped at time point t1 at which the pressure raise continuation duration Tx elapses.

After that, residual heat from the engine 2 heats the amount of fuel contained in the fuel distribution pipe 50, so that the fuel tends to expand and the fuel pressure P tends to rise in the fuel distribution pipe 50. However, the relief valve 54*g* slightly opens so as to discharge an amount of fuel corresponding to the thermal expansion toward the discharge path 54*h*. Therefore, the fuel pressure P is kept substantially constantly at the set valve opening pressure of the relief valve 54*g* for a while.

After that, the thermal expansion diminishes, and then the fuel pressure P within the fuel distribution pipe 50 starts to decrease due to the leakage of fuel via the relief valve 54*g*. Then, the fuel pressure P continues falling as long as the engine 2 remains stopped. However, the fuel pressure P does not decrease below the fuel pressure control range (8 to 13 MPa in this embodiment) before time point t3. From time point t3 on, the fuel pressure P becomes below the fuel pressure control range.

If the process of raising the fuel pressure P immediately prior to the engine automatic stop is not performed as in the case of the conventional art, the fuel pressure P temporarily rises slightly due to thermal expansion. However, after a short time (time point t2), the fuel pressure P decreases below the fuel pressure control range.

In the above-described process, S220, S230, S430, S440 and S450 correspond to a process as a fuel pressure raising means.

The first embodiment as described above achieves the following advantages.

(1-1) Due to the process of S220, S230, S430, S440 and S450, the fuel pressure P is raised immediately prior to the automatic stop. Therefore, after the engine 2 stops and the delivery of high-pressure fuel from the high-pressure fuel pump 54 toward the fuel injection valves 22 stops, the pressure fall starts from an increased fuel pressure P in comparison with the case where the engine 2 is stopped with an ordinary fuel pressure state as in the conventional art. Therefore, an increased engine stop time is allowed before the fuel pressure decreases to a fuel pressure that makes it impossible to perform appropriate fuel injection into each combustion chamber 10 during the compression stroke. According to the first embodiment, the period between time points t1 and t3 is the period during which it is possible to perform appropriate fuel injection into each combustion chamber 10 during the compression stroke, as indicated in FIG. 19. In contrast, according to the conventional art, the period between time points t1 and t2 is the period during which it is possible to perform appropriate fuel injection into each combustion chamber 10 during the compression stroke.

That is, according to the conventional art, if the automatic start is performed between time points t2 and t3, negative determination is made ("NO") in S104 in FIG. 8 immediately after the start of the engine 2, so that the mode F3 is set as a mode of operation. Thus, fuel injection during the compression stroke cannot be performed, and fuel injection during the intake stroke is performed. According to Embodiment 1, if the automatic start is performed between time points t2 and t3, affirmative determination is made ("YES") in S104 in FIG. 8, so that the mode F1 or F2 can be set as a mode of operation to perform fuel injection during the compression stroke provided that the engine 2 is in an operating state that allows stratified charge combustion.

Therefore, it becomes possible to increase the frequency of performances of the compression-stroke injection after an automatic start. Hence, it becomes possible to sufficiently achieve improvements in fuel economy and the like.

(1-2) As a means for raising the fuel pressure P immediately prior to the automatic stop, the control duty DT of the electromagnetic spill valve 55 is set to 100% to adjust the amount of delivery from the high-pressure fuel pump 54 to a maximum.

By utilizing the range where the amount of delivery from the high-pressure fuel pump 54 is maximum, the fuel pressure P can be rapidly raised to a sufficiently high pressure state. Therefore, the frequency of performances of the compression-stroke injection after an automatic start further increases, and the fuel economy improvement becomes more effective.

(1-3) By maintaining the maximum amount of delivery from the high-pressure fuel pump 54 during the pressure raise continuation duration Tx immediately prior to the automatic stop, the fuel pressure P is raised to or above the set valve opening pressure of the relief valve 54*g*. This process provides an occasion of opening the relief valve 54*g*, which is scarcely ever opened during normal operation.

Therefore, it becomes possible to prevent the locking of the relief valve 54*g* or the clogging thereof with a foreign matter, which is likely to occur after the relief valve 54*g* has not been opened for a long time.

Second Embodiment

A second embodiment differs from Embodiment 1 described above in the length of the pressure raise continuation duration Tx related to step S440 of the automatic stop control process (FIG. 17). Other constructions of the second embodiment are the same as those of the first embodiment. That is, in addition to increasing the fuel pressure P to or above the set valve opening pressure of relief valve 54*g* immediately prior to the automatic stop, the second embodiment, after the set valve opening pressure of the relief valve 54*g* is reached or exceeded, keeps the control duty DT of the electromagnetic spill valve 55 at 100% until a certain amount of fuel is discharged from the fuel distribution pipe 50 via the relief valve 54*g*. Therefore, the pressure raise continuation duration Tx is set longer in this embodiment than in the first embodiment.

Figure 20:
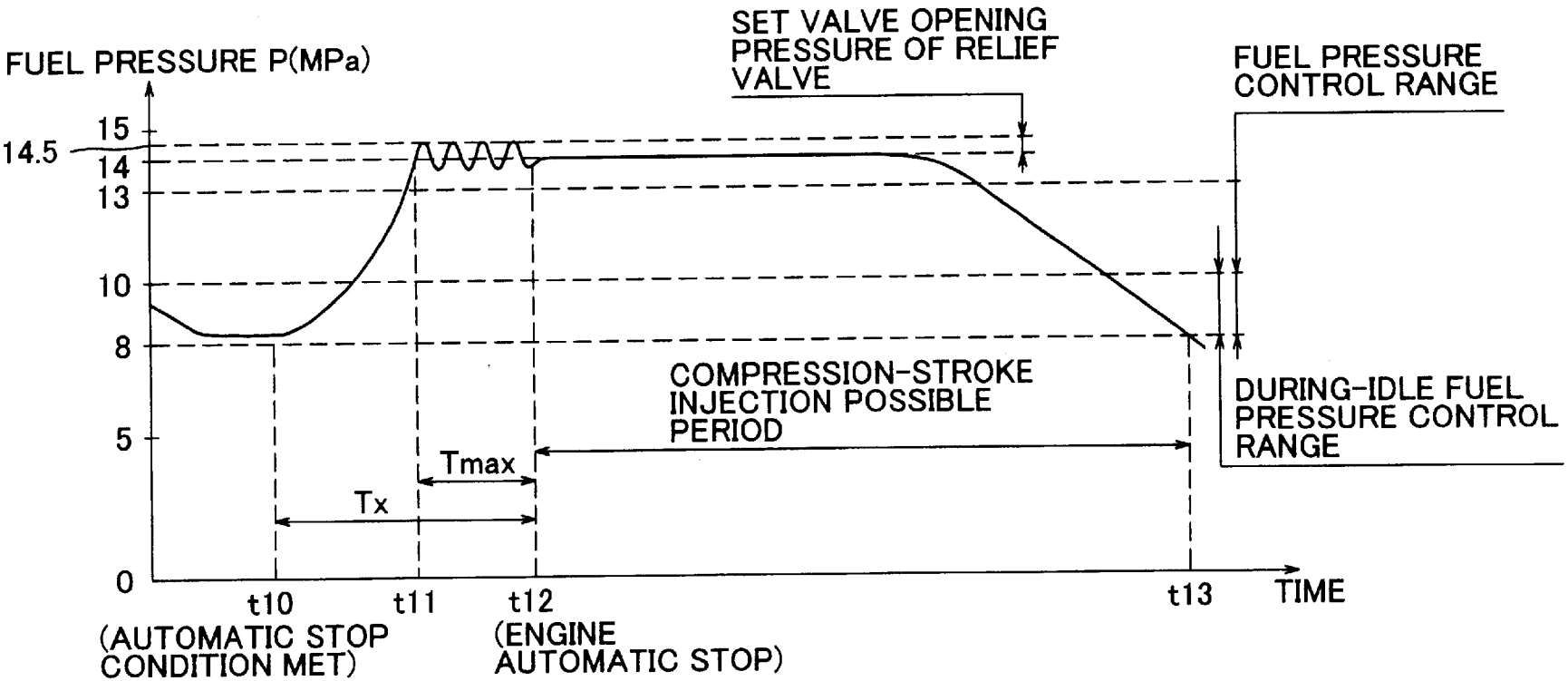
FIG. 20 is a timing chart illustrating an example of the control of the fuel pressure P in Embodiment 2.

As a result, the relief valve 54*g* is opened repeatedly during a period Tmax as indicated in the timing chart of FIG. 20. That is, while a large amount of fuel is being delivered from the high-pressure fuel pump 54 to the fuel distribution pipe 50, a state in which a portion of the fuel delivered into the fuel distribution pipe 50 is discharged into the discharge path 54*h* via the relief valve 54*g* is repeated.

According to Embodiment 2 described above, the following advantages are achieved.

(2-1) The advantages (1-1) to (1-3) of the first embodiment are achieved.

(2-2) Even after the fuel pressure P is raised to or above the set valve opening pressure of the relief valve 54*g*, the process of raising the fuel pressure P to or above the set valve opening pressure of the relief valve 54*g* is continued for a while. As a result, immediately prior to the automatic stop, the relief valve 54*g* is repeatedly opened, and a large amount of fuel is delivered toward the fuel distribution pipe 50, so that the fuel temperature in the fuel distribution pipe 50 drops immediately before the automatic stop.

Therefore, it is possible to maintain a sufficiently high fuel pressure achieved by thermal expansion caused by increases in the fuel temperature during the automatic stop of the engine 2. Hence, the frequency of performing the compression-stroke injection after an automatic start can be further increased, and improvements in fuel economy and the like can be more effectively achieved.

Third Embodiment

Figure 21:
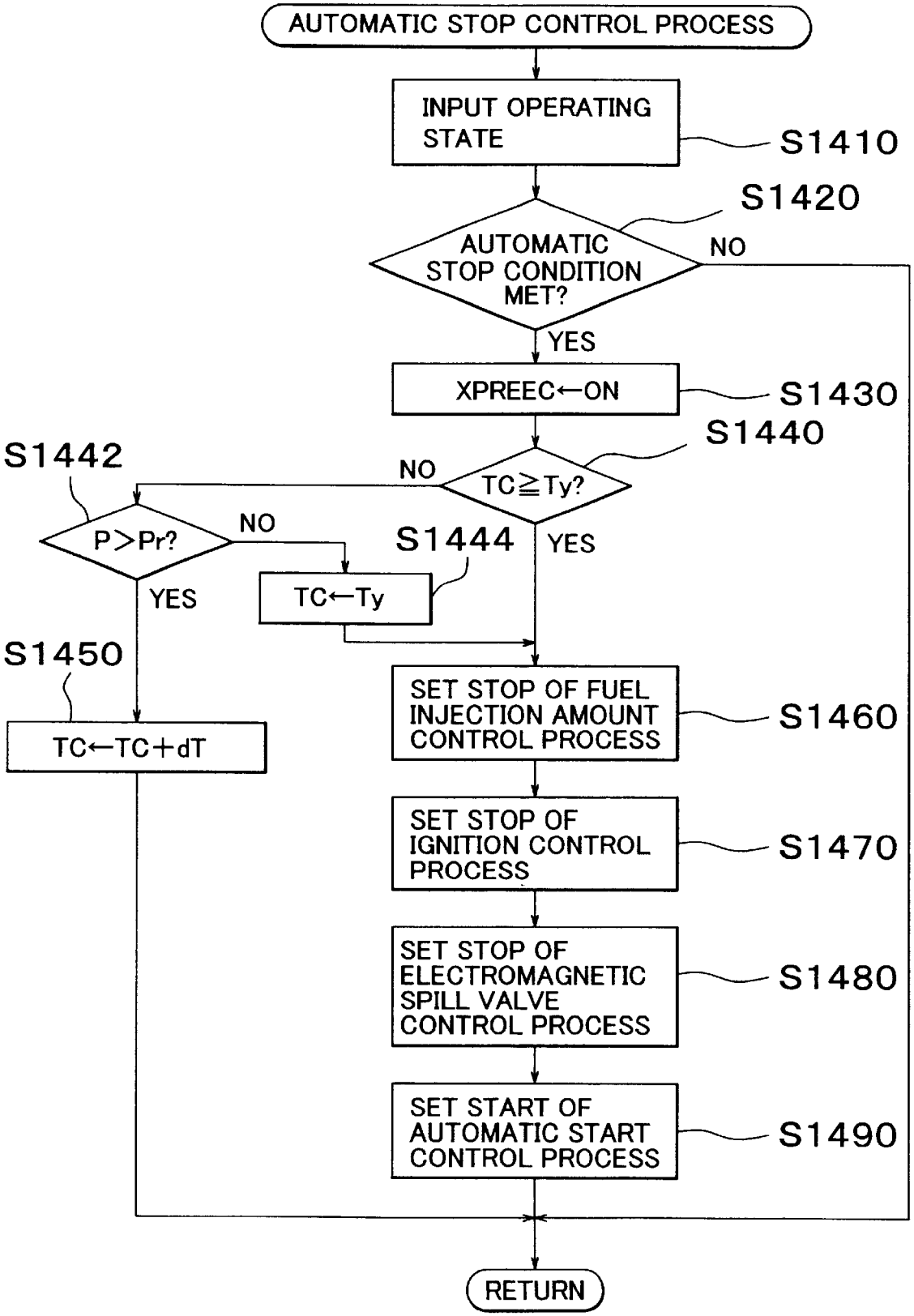
FIG. 21 is a flowchart illustrating an automatic stop control process in Embodiment 3.

In a third embodiment, it is determined whether to execute the automatic stop by monitoring the fuel pressure P. The automatic stop control process (FIG. 17) in the first embodiment is replaced by execution of a process illustrated in FIG. 21. Other constructions of the third embodiment are the same as those of Embodiment 1. The automatic stop control process illustrated in FIG. 21 differs from the automatic stop control process (FIG. 17) of the first embodiment only in the processing of S1440, S1442 and S1444. The other steps in FIG. 21 perform the same processing as in the steps in FIG. 17 represented by step numbers equal to the three lower digits of the step numbers of the steps in FIG. 21.

If "YES" in S1420, that is, if the automatic stop condition is met, the immediately-before-automatic-stop flag XPREEC is set to "ON" in S1430. Subsequently in S1440, it is determined whether the timer counter TC has reached or exceeded a time limit Ty. The time limit Ty is a criterion time provided for allowing the transition to the automatic stop without waiting for the raise in the fuel pressure P if the raise in the fuel pressure P is slow from any cause.

If "NO" in S1440, that is, if TC<Ty, it is then determined in S1442 whether the fuel pressure P is less than, for example, a pressure raise criterion pressure value Pr that is set within a range from the upper limit value (e.g., 13 MPa in this embodiment) of the fuel pressure control range to the set valve opening pressure (e.g., 14 MPa) of the relief valve 54*g*.

If "YES" in S1442, that is, P<Pr, the process proceeds to S1450, in which the counting-up of the timer counter TC is executed as in Equation 5. After that, the process is temporarily ended.

If "YES" in S1420, that is, while the time limit Ty has not elapsed after the automatic stop condition is met, the processing of S1410, S1420, S1430, S1440, S1442, S1450 is repeated, so that XPREEC="ON" is maintained. Thus, the state of control duty DT=100(%) with respect to the electromagnetic spill valve 55 continues.

If "NO" in S1442, that is, if P≧Pr is established due to increases in the fuel pressure P, the value of the time limit Ty is set in the timer counter TC in S1444. Subsequently in S1460, the stop setting for the fuel injection amount control process as illustrated in FIG. 11 is made. Then, in S1470, the stop setting for the ignition control process is made. As a result, the fuel injection and the ignition stop, and the operation of the engine 2 immediately stops. Due to the stop of the engine 2, the driving of the high-pressure fuel pump 54 also stops, and the check valve 54*b* is closed. Therefore, the inside of the fuel distribution pipe 50 is tightly closed in a high-pressure fuel state achieved by raising the fuel pressure from an ordinary level (the pressure being not higher than the set valve opening pressure of the relief valve 54*g*) due to the control duty DT=100(%) immediately before the stop o f the engine 2. Subsequently in S1480, the setting for a stop is also made with respect to the electromagnetic spill valve control process (FIG. 14), and the output of the control duty signal is stopped. Subsequently in S1490, a start of the automatic start control process (FIG. 18) is set. After that, the process is temporarily ended. In the above-described process, S229, S230 (FIG. 14), S1430 and S1442 correspond the processing as a fuel pressure raising means.

According to Embodiment 3 described above, then following advantages are achieved.

(3-1) The advantages (1-1) and (1-2) of Embodiment 1 are achieved.

(3-2) Since pressure rise is directly monitored based on the value of the fuel pressure P, the timing of the automatic stop can be more accurately determined. Therefore, the automatic stop can be executed during an early period, and improvements in fuel economy and the like can be more effectively achieved.

(3-3) The provision of the time limit Ty ensures the transition to the automatic stop even if the fuel pressure P is slow to rise from any cause.

Fourth Embodiment

Figure 22:
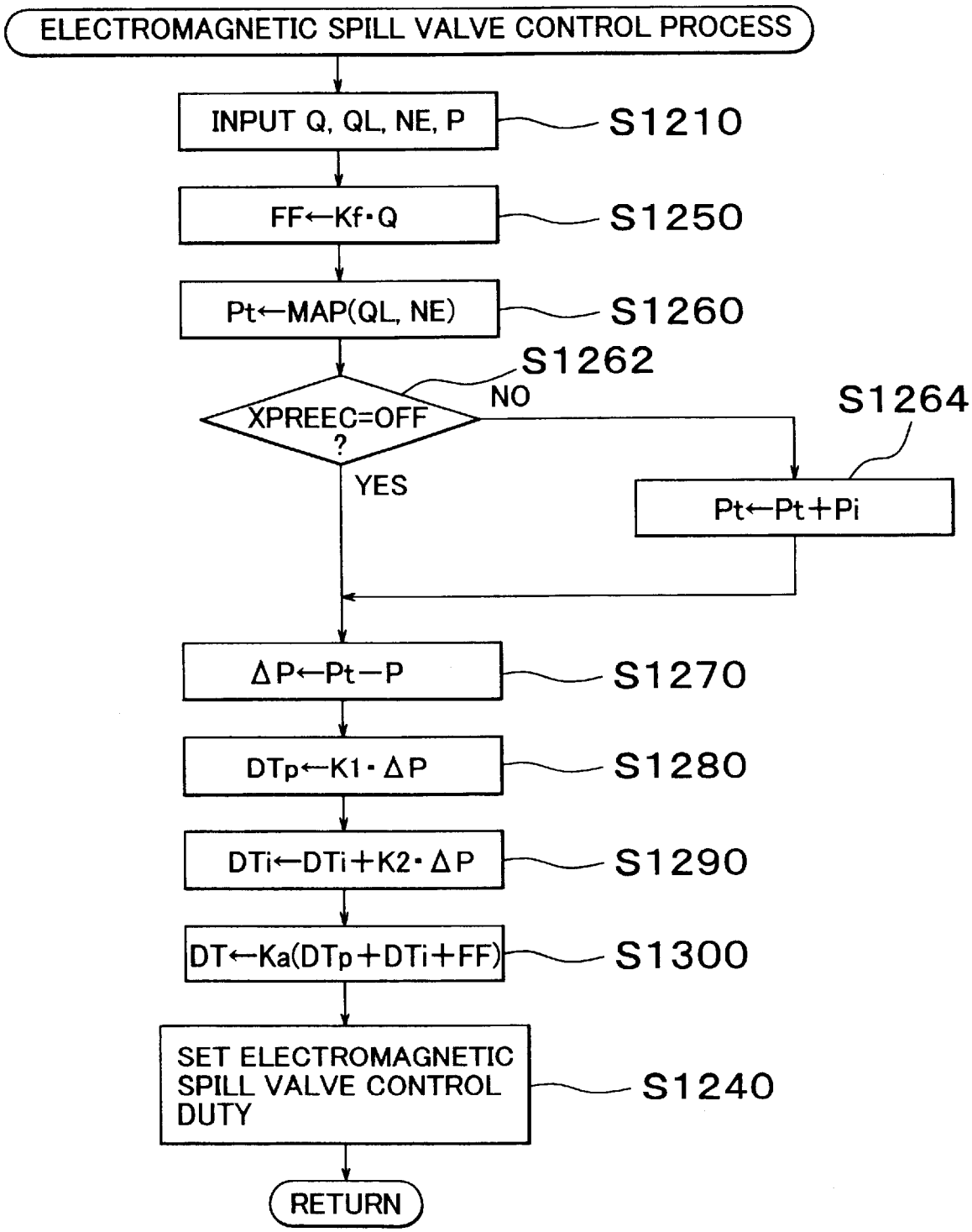
FIG. 22 is a flowchart illustrating an electromagnetic spill valve control process in Embodiment 4.

A fourth embodiment raises the fuel pressure P by correcting the target fuel pressure Pt in the increasing direction immediately prior to the automatic stop, instead of setting the control duty DT to 100%. Therefore, a process illustrated in FIG. 22 is executed in place of the electromagnetic spill valve control process (FIG. 14) of Embodiment 1. Other constructions of the fourth embodiment are the same as those of Embodiment 1. The steps of S1210, S1250, S1260, S1270 to S1300, and S1240 in FIG. 22, other than S1262 and S1264 of the electromagnetic spill valve control process, perform the same processing as in the steps in FIG. 14 represented by step numbers equal to the three lower digits of the step numbers of the steps in FIG. 22.

That is, after a target fuel pressure Pt is determined in S1260 from the lean fuel injection amount QL and the engine revolution speed NE using the map indicated in FIG. 16, it is determined in S1262 whether the immediately-before-automatic-stop flag XPREEC is "OFF".

If "YES" in S1262, that is, if XPREEC="OFF", the process proceeds to S1270, in which a pressure deviation ΔP between the actual fuel pressure P and the target fuel pressure Pt calculated in S1260 is calculated. Subsequently in S1280, a proportional term DTp is calculated from the product of the pressure deviation ΔP and the proportionality factor K1. Then, in S1290, an integral term DTi is calculated based on the product (K2·ΔP) of the pressure deviation ΔP and the integration factor K2, as expressed in Equation 3.

Subsequently in S1300, a control duty DT for setting the closed valve duration (delivery duration) of the electromagnetic spill valve 55 is calculated as expressed in Equation 4. Subsequently in S1240, this control duty DT is set as a control duty DT that represents the closed valve duration of the electromagnetic spill valve 55 in the pressurization stroke of the high-pressure fuel pump 54. After that, the process is temporarily ended.

Conversely, if "NO" in S1262, that is, if XPREEC="ON", the target fuel pressure Pt is increased for correction in S1264, as expressed in Equation 6.

$$Pt \rightarrow Pt+Pi \qquad \text{[Eq. 6]}$$

where Pi represents an increasing correction value.

After that, in S1270, a pressure deviation ΔP between the actual fuel pressure P and the target fuel pressure Pt corrected to an increase side in S1264 is calculated. After that, S1280 to S1300 are executed, so that a control duty DT is calculated. Subsequently in S1240, this control duty DT is set as a control duty that represents the closed valve duration of the electromagnetic spill valve 55 in the pressurization stroke of the high-pressure fuel pump 54. After that, the process is temporarily ended.

Thus, if "NO" in S1262, that is, if XPREEC="ON", the fuel pressure P is adjusted so as to provide a pressure that is higher than usual.

In the above-described process, S1262 and S1264, and S430, S440 and S450 (FIG. 17) correspond to the processing as a fuel pressure raising unit, and S1210, S1250, S1260, S1270 to S1300, and S1240 correspond to the processing as a fuel pressure control unit.

According to Embodiment 4 described above, the following advantage is achieved.

(4-1) The advantage (1-1) of the first embodiment is achieved.

Other Embodiments

In Embodiments 1 to 4, the pressure raise continuation duration Tx or the time limit Ty may also be set in accordance with the operating state of the engine 2.

In Embodiment 4, the target fuel pressure Pt increased for correction in S1264 may also be set to a value that is greater than or equal to the set valve opening pressure of the relief valve 54*g*, to open the relief valve 54*g*, so that the fixation of the relief valve 54*g* or the clogging thereof with a foreign matter can be prevented. Furthermore, after the actual fuel pressure P reaches a value that is greater than or equal to the set valve opening pressure of the relief valve 54*g*, the increasing correction of the target fuel pressure Pt in S1264 may be continued so as to decrease the fuel temperature in the fuel distribution pipe 50.

Although in the automatic stop control process (FIGS. 17 and 21) in Embodiments 1 and 3, the stop setting for the ignition control process is performed in S470 and S1470, the stop setting for the ignition control process may be omitted since revolution of the engine 2 stops merely upon a stop of fuel injection.

While embodiments of the invention have been described, it is to be noted that embodiments of the invention further include the following forms.

(1) In a mode of the invention, an automatic stop permitting unit of the direct injection type internal combustion engine permits execution of the automatic stop when the fuel pressure on the fuel injection valve side is raised to a reference pressure by the fuel pressure raising unit.

(2) In a mode of the invention, an automatic stop permitting unit of the direct injection type internal combustion engine permits execution of the automatic stop when the elapsed time of the pressure raising process executed by the fuel pressure raising unit reaches or exceeds a reference time.

What is claimed is:

1. A control apparatus of a direct injection type internal combustion engine in which an air-fuel mixture formed by injecting a fuel delivered from a fuel pump, directly from a fuel injection valve into a combustion chamber, is ignited by an ignition plug, the control apparatus comprising:

an automatic stop permitting unit that permits an automatic stop of the internal combustion engine if during an operation of the internal combustion engine, an operating state of the internal combustion engine meets an automatic stop condition;

an automatic start permitting unit that permits an automatic start of the internal combustion engine if the operating state of the internal combustion engine meets an automatic start condition; and a fuel pressure raising unit that raises a fuel pressure on a fuel injection valve side during a first period of time_prior to the automatic stop permitted by the automatic stop permitting unit.

2. A control apparatus according to claim 1, wherein the fuel pressure raising unit raises the fuel pressure on the fuel injection valve side during the first period of time prior to the automatic stop by adjusting an amount of the fuel delivered from the fuel pump to a maximum.

3. A control apparatus according to claim 2, wherein:

the internal combustion engine includes a relief valve that opens and discharges the fuel from the fuel injection valve side when the fuel pressure on the fuel injection valve side reaches at least a predetermined valve opening pressure; and during the first period of time prior to the automatic stop, the fuel pressure raising unit raises the fuel pressure on the fuel injection valve side so as to temporarily open the relief valve by adjusting the amount of the fuel delivered from the fuel pump to the maximum.

4. A control apparatus according to claim 1, further comprising a fuel pressure control unit that adjusts the fuel pressure on the fuel injection valve side to a target fuel pressure that is set in accordance with the operating state of the internal combustion engine by adjusting an amount of the fuel delivered from the fuel pump, wherein the fuel pressure raising unit raises the fuel pressure on the fuel injection valve side prior to the automatic stop by correcting the target fuel pressure to a higher level.

5. A control apparatus according to claim 1, wherein:

the internal combustion engine includes a relief valve that opens and discharges the fuel from the fuel injection valve side when the fuel pressure on the fuel injection valve side reaches at least a predetermined valve opening pressure; and the fuel pressure raising unit raises the fuel pressure on the fuel injection valve side to at least the predetermined valve opening pressure of the relief valve prior to the automatic stop.

6. A control apparatus according to claim 4, wherein:

the internal combustion engine includes a relief valve that opens and discharges the fuel from the fuel injection valve side when the fuel pressure on the fuel injection valve side reaches at least a predetermined valve opening pressure; and the fuel pressure raising unit raises the fuel pressure on the fuel injection valve side to at least the predetermined valve opening pressure of the relief valve prior to the automatic stop.

7. A control apparatus according to claim 5, wherein the fuel pressure raising unit keeps the fuel pressure equal to or higher than the predetermined valve opening pressure of the relief valve during a second period of time prior to the automatic stop after the fuel pressure raising unit raises the fuel pressure to at least the predetermined valve opening pressure of the relief valve.

8. A control apparatus according to claim 6, wherein the fuel pressure raising unit keeps the fuel pressure equal to or higher than the predetermined valve opening pressure of the relief valve during a second period of time prior to the automatic stop after the fuel pressure raising unit raises the fuel pressure to at least the predetermined valve opening pressure of the relief valve.

9. A control apparatus according to claim 1, wherein the automatic stop permitting unit permits the internal combustion engine to automatically stop when the fuel pressure on the fuel injection valve side is raised to a reference pressure by the fuel pressure raising unit.

10. A control apparatus according to claim 1, wherein the automatic stop permitting unit permits the internal combustion engine to automatically stop when an elapsed time of a pressure raising process executed by the fuel pressure raising unit reaches at least a reference time.

11. A control method of a direct injection type internal combustion engine in which an air-fuel mixture formed by injecting a fuel delivered from a fuel pump, directly from a fuel injection valve into a combustion chamber, is ignited by an ignition plug, the control method comprising the steps of:

permitting an automatic stop of the internal combustion engine if during an operation of the-internal combustion engine, an operating state of the internal combustion engine meets an automatic stop condition;

permitting an automatic start of the internal combustion engine if the operating state of the internal combustion engine meets an automatic start condition; and raising a fuel pressure on a fuel injection valve side during a first period of time prior to the permitted automatic stop.

12. A control method according to claim 11, wherein the fuel pressure on the fuel injection valve side is raised during the first period of time prior to the automatic stop by adjusting an amount of the fuel delivered from the fuel pump to a maximum.

13. A control method according to claim 12, wherein:

the internal combustion engine includes a relief valve which opens and discharges the fuel from the fuel injection valve side when the fuel pressure on the fuel injection valve side reaches at least a predetermined valve opening pressure; and the fuel pressure on the fuel injection valve side is raised during the first period of time prior to the automatic stop to temporarily open the relief valve by adjusting the amount of the fuel delivered from the fuel pump to the maximum.

14. A control method according to claim 11, wherein:

the fuel pressure on the fuel injection valve side is adjusted to a target fuel pressure that is set in accordance with the operating state of the internal combustion engine by adjusting an amount of the fuel delivered from the fuel pump; and the fuel pressure on the fuel injection valve side is raised prior to the automatic stop by correcting the target fuel pressure to a higher level.

15. A control method according to claim 11, wherein:

the internal combustion engine includes a relief valve which opens and discharges the fuel from the fuel injection valve side when the fuel pressure on the fuel injection valve side reaches at least a predetermined valve opening pressure; and the fuel pressure on the fuel injection valve side is raised to at least the predetermined valve opening pressure of the relief valve prior to the automatic stop.

16. A control method according to claim 14, wherein:

the internal combustion engine includes a relief valve which opens and discharges the fuel from the fuel injection valve side when the fuel pressure on the fuel injection valve side reaches at least a predetermined valve opening pressure; and the fuel pressure on the fuel injection valve side is raised to at least the predetermined valve opening pressure of the relief valve prior to the automatic stop.

17. A control method according to claim 15, wherein the fuel pressure is kept equal to or higher than the predetermined valve opening pressure of the relief valve during a second period of time prior to the automatic stop after raising the fuel pressure to at least the predetermined valve opening pressure of the relief valve.

18. A control method according to claim 16, wherein the fuel pressure is kept equal to or higher than the predetermined valve opening pressure of the relief valve during a second period of time prior to the automatic stop after raising the fuel pressure to at least the predetermined valve opening pressure of the relief valve.

19. A control method according to claim 11, wherein the internal combustion engine is permitted to automatically stop when the fuel pressure on the fuel injection valve side is raised to a reference pressure.

20. A control method according to claim 11, wherein the internal combustion engine is permitted to automatically stop when an elapsed time of a pressure raising process reaches at least a reference time.

* * * * *

UNITED STATES PATENT AND TRADEMARK OFFICE

CERTIFICATE OF CORRECTION

PATENT NO. : 6,474,294 B2
DATED : November 5, 2002
INVENTOR(S) : Daichi Yamazaki et al.

It is certified that error appears in the above-identified patent and that said Letters Patent is hereby corrected as shown below:

Column 2,
Line 5, change "of. a direct" to -- of a direct --.
Line 49, change "time__prior" to -- time prior --.

Column 12,
Line 3, change "*Q→OBS{1…*" to -- *Q←OBS{1…* --.

Column 13,
Line 18, change "*ΔP→Pt-P*" to -- *ΔP←Pt-P* --.
Line 26, change "*DTi→DTi…*" to -- *DTi←DTi…* --.
Line 34, change "*DT→Ka…*" to -- *DT←Ka…* --.

Column 14,
Line 33, change "*TC→TC+dT*" to -- *TC←TC+dT* --.

Column 20,
Line 7, change "*Pt→Pt+Pi*" to -- *Pt←Pt+Pi* --.

Signed and Sealed this

Ninth Day of March, 2004

JON W. DUDAS
*Acting Director of the United States Patent and Trademark Office*